US012479558B2

(12) United States Patent
Czarnowski et al.

(10) Patent No.: US 12,479,558 B2
(45) Date of Patent: Nov. 25, 2025

(54) SUPPORT ASSEMBLIES FOR WATERCRAFTS AND RELATED METHODS OF ASSEMBLY

(71) Applicant: White River Marine Group, LLC, Springfield, MO (US)

(72) Inventors: James Taylor Czarnowski, Fallbrook, CA (US); Jason Christopher Kardas, Oceanside, CA (US); William John Broadway, San Clemente, CA (US); Drew William Brackett, Solana Beach, CA (US); Philip James Dow, Oceanside, CA (US); Elizabeth Catherine Sexton, San Clemente, CA (US); Shane Michael Yellin, Carlsbad, CA (US)

(73) Assignee: White River Marine Group, LLC, Springfield, MO (US)

( * ) Notice: Subject to any disclaimer, the term of this patent is extended or adjusted under 35 U.S.C. 154(b) by 612 days.

(21) Appl. No.: 17/713,692

(22) Filed: Apr. 5, 2022

(65) Prior Publication Data

US 2022/0324546 A1 Oct. 13, 2022

Related U.S. Application Data

(60) Provisional application No. 63/171,901, filed on Apr. 7, 2021.

(51) Int. Cl.

| | |
|---|---|
| ***B63H 21/30*** | (2006.01) |
| ***B63B 34/21*** | (2020.01) |
| ***B63H 16/18*** | (2006.01) |

(52) U.S. Cl.

CPC ..... *B63H 21/30* (2013.01); *B63B 34/21* (2020.02); *B63H 16/18* (2013.01)

(58) Field of Classification Search

CPC .. B63H 16/14; B63H 16/18; B63H 2016/202; B63H 21/30; B63B 32/66; B63B 34/21; B63B 34/26; B63B 34/50; B63B 34/565

(Continued)

(56) References Cited

U.S. PATENT DOCUMENTS

| | | | |
|---|---|---|---|
| 35,451 | A | 6/1862 | Johnson |
| 2,286,914 | A | 6/1942 | Knapp |

(Continued)

FOREIGN PATENT DOCUMENTS

| | | |
|---|---|---|
| CA | 3035190 | 8/2020 |
| GB | 452719 | 8/1936 |

(Continued)

OTHER PUBLICATIONS hobiecat.com [online], "Hobie Kayak Catalog," available on or before Jul. 18, 2006, retrieved from URL<http://web.archive.org/web/20060718165521/www.hobiecat.com/media/pdf/Hobie_Kayak.pdf>, 28 pages.

(Continued)

*Primary Examiner* — Daniel V Venne

(74) *Attorney, Agent, or Firm* — Dinsmore & Shohl LLP

(57) ABSTRACT

A watercraft includes a hull, an opening extending vertically through the hull, and a support assembly configured to mount a propulsion mechanism to the watercraft. The hull at least partially defines the opening. The support assembly includes a rightward support device attached to the hull, positioned between a forward portion of the opening and a rearward portion of the opening, and at least partially defining a right lateral portion of the opening. The support assembly further includes a leftward support device attached to the hull, positioned between the forward portion of the opening and the rearward portion of the opening, and at least partially defining a left lateral portion of the opening.

35 Claims, 41 Drawing Sheets

(58) Field of Classification Search
USPC ..... 114/343, 347, 382; 440/13, 21, 25, 26, 440/38
See application file for complete search history.

(56) References Cited

U.S. PATENT DOCUMENTS

| | | | | |
|---|---|---|---|---|
| 2,743,510 | A | 5/1956 | Mauney et al. | |
| 2,873,713 | A | 2/1959 | Baastrup | |
| 2,948,255 | A | 8/1960 | Adolphe | |
| 3,032,001 | A | 5/1962 | Kiker | |
| 3,095,850 | A | 7/1963 | Stolzer | |
| 3,649,977 | A | 3/1972 | Grabenauer | |
| 3,682,123 | A | 8/1972 | Edwards | |
| 3,695,211 | A | 10/1972 | Gross | |
| 4,228,751 | A | 10/1980 | Robertson et al. | |
| 4,318,700 | A | 3/1982 | Price | |
| 4,462,331 | A | 7/1984 | McCrory | |
| 4,474,502 | A | 10/1984 | Daoud | |
| 4,490,119 | A | 12/1984 | Young | |
| 4,511,338 | A | 4/1985 | Fanelli | |
| 4,828,517 | A | 5/1989 | van Liefland | |
| 4,936,802 | A | 6/1990 | Ueno | |
| 4,960,396 | A | 10/1990 | Stolzer | |
| 5,030,146 | A | 7/1991 | Chung | |
| 5,090,930 | A | 2/1992 | Walden | |
| 5,145,424 | A | 9/1992 | Han | |
| 5,170,738 | A | 12/1992 | Patten | |
| 5,183,422 | A | 2/1993 | Guiboche | |
| 5,194,024 | A | 3/1993 | Shiraki | |
| 5,413,066 | A | 5/1995 | Spencer, Jr. et al. | |
| 5,453,031 | A | 9/1995 | Gagnier | |
| 5,460,551 | A | 10/1995 | Beres | |
| 5,460,552 | A | 10/1995 | Blanchard et al. | |
| 5,474,481 | A | 12/1995 | Ramsey | |
| 5,481,991 | A | 1/1996 | Geerts | |
| 5,651,706 | A | 7/1997 | Kasper | |
| 5,878,688 | A | 3/1999 | Merrett et al. | |
| 6,022,249 | A | 2/2000 | Ketterman | |
| 6,223,678 | B1 | 5/2001 | Haller et al. | |
| 6,609,939 | B1 | 8/2003 | Towner et al. | |
| 6,863,014 | B2 | 3/2005 | Hudson et al. | |
| 7,007,628 | B1 | 3/2006 | Conley | |
| 7,430,976 | B2 | 10/2008 | Ketterman et al. | |
| 8,082,871 | B2 | 12/2011 | Czarnowski et al. | |
| 8,753,156 | B2 | 6/2014 | Ketterman et al. | |
| 9,475,559 | B2 | 10/2016 | Czarnowski et al. | |
| 9,623,944 | B2 | 4/2017 | Kuehmichel et al. | |
| 9,701,367 | B2 | 7/2017 | McDonough et al. | |
| 9,725,149 | B2 * | 8/2017 | Kiffmeyer | B63H 16/20 |
| 9,914,519 | B2 | 3/2018 | Nutz et al. | |
| 10,220,924 | B1 | 3/2019 | Horvath et al. | |
| 11,148,775 | B2 * | 10/2021 | Kuehmichel | B60L 50/20 |
| 11,332,227 | B2 * | 5/2022 | Clegg | B63H 16/20 |
| 11,518,481 | B2 * | 12/2022 | Steed | B63H 16/20 |
| 11,572,143 | B2 * | 2/2023 | Kuehmichel | B63H 23/12 |
| 11,655,013 | B2 * | 5/2023 | Clegg | B63B 34/50 440/21 |
| 2005/0172882 | A1 | 8/2005 | Yung | |
| 2006/0055084 | A1 * | 3/2006 | Yamaguchi | C25D 11/18 264/274 |
| 2009/0042461 | A1 | 2/2009 | Walton | |
| 2009/0061703 | A1 | 3/2009 | Song et al. | |
| 2010/0025889 | A1 | 2/2010 | Riggins et al. | |
| 2013/0032079 | A1 | 2/2013 | Erdahl et al. | |
| 2016/0009345 | A1 | 1/2016 | Gray | |
| 2018/0009515 | A1 | 1/2018 | Murphy | |
| 2019/0061895 | A1 | 2/2019 | Dow et al. | |
| 2020/0269963 | A1 | 8/2020 | Boyer et al. | |
| 2021/0047021 | A1 | 2/2021 | Boyer et al. | |
| 2021/0221477 | A1 | 7/2021 | Steed et al. | |

FOREIGN PATENT DOCUMENTS

| | | | |
|---|---|---|---|
| JP | S5233290 | A | 3/1977 |
| JP | H01144198 | U | 10/1989 |
| JP | H335897 | U | 4/1991 |
| KR | 101659256 | | 9/2016 |
| KR | 20180001004 | | 1/2018 |
| WO | WO 2009017626 | | 2/2009 |
| WO | WO 2018009206 | | 1/2018 |
| WO | WO 2019021062 | | 1/2019 |

OTHER PUBLICATIONS

Howe et al., boston.com [online], "Penguin Power Birds To Challenge The Propeller," The Boston Globe, May 12, 1997, retrieved on Aug. 13, 2008, 2 pages.

PCT International Search Report and Written Opinion in International Application No. PCT/US2022/023459, dated Jul. 29, 2022, 14 pages.

International Preliminary Report on Patentability in International Appln. No. PCT/US2022/023459, mailed on Oct. 19, 2023, 9 pages.

* cited by examiner

SUPPORT ASSEMBLIES FOR WATERCRAFTS AND RELATED METHODS OF ASSEMBLY

CROSS-REFERENCE TO RELATED APPLICATIONS

This application claims priority to U.S. Application No. 63/171,901, filed on Apr. 7, 2021, which is hereby incorporated by reference in its entirety.

TECHNICAL FIELD

This specification relates to support assemblies for watercrafts and related methods of assembly.

BACKGROUND

A watercraft can include a propulsion system that can be operated to move the watercraft in water. The propulsion system can vary, depending on a type of the watercraft. The propulsion system can be foot-operated, hand-operated, electrically-operated, or driven in another manner.

SUMMARY

This disclosure provides watercrafts various support assemblies for mounting a propulsion mechanism to a watercraft. The support assemblies accept a variety of propulsion mechanism modules, thereby allowing the watercraft to be used with different modes of propulsion, e.g., foot-driven, hand-driven, electrically-driven, etc. Implementations of the support assemblies can vary in the number of components, in the way that the support assemblies are attached to the hull of the watercraft, and in the intended load path for propulsion mechanisms supported in the watercraft.

In one aspect, a watercraft includes a hull, an opening extending vertically through the hull, and a support assembly configured to mount a propulsion mechanism to the watercraft. The hull at least partially defines the opening. The support assembly includes a rightward support device attached to the hull, positioned between a forward portion of the opening and a rearward portion of the opening, and at least partially defining a right lateral portion of the opening. The support assembly further includes a leftward support device attached to the hull, positioned between the forward portion of the opening and the rearward portion of the opening, and at least partially defining a left lateral portion of the opening.

In some implementations, a dimension of the opening along a fore-aft axis of the watercraft is longer than a dimension of the opening along a left-right axis of the watercraft.

In some implementations, a dimension of the rightward support device along a fore-aft axis of the watercraft is less than 50% of the dimension of the opening, and a dimension of the leftward support device is less than 50% of the dimension of the opening.

In some implementations, the rightward support device includes a first bearing surface to mount a shaft of the propulsion mechanism to the watercraft, and the leftward support device includes a second bearing surface to mount the shaft of the propulsion mechanism to the watercraft. In some implementations, the watercraft further includes a locking mechanism to releasably lock the shaft of the propulsion mechanism to the watercraft when the propulsion mechanism is mounted to the support assembly. In some implementations, wherein the locking mechanism includes a first lever including a first cam surface to engage the shaft of the propulsion mechanism when the propulsion mechanism is mounted to the support assembly, and a second lever including a second cam surface to engage the shaft of the propulsion mechanism when the propulsion mechanism is mounted to the support assembly. The first lever can be rotatably mounted to the rightward support device. The second lever can be rotatably mounted to the leftward support device.

In some implementations, a forward portion of the opening is defined by an upwardly-directed surface to abut a forward portion of the propulsion mechanism when the propulsion mechanism is mounted to the support assembly. In some implementations, a rearward portion of the opening is defined by an upwardly-directed surface to abut a rear portion of the propulsion mechanism when the propulsion mechanism is mounted to the support assembly.

In some implementations, the hull includes an upper portion and a lower portion, and the rightward and leftward support devices extend along the upper portion and the lower portion of the hull. In some implementations, the upper portion of the hull is welded to the lower portion of the hull.

In some implementations, the hull includes a rightward slot to receive the rightward support device and includes a leftward slot to receive the leftward support device. In some implementations, the hull includes an inner surface at least partially defining the opening, the rightward slot and the leftward slot being recessed relative to the inner surface.

In some implementations, the rightward slot and the leftward slot are recessed relative to a top surface of the hull.

In some implementations, the watercraft further includes the propulsion mechanism. The propulsion mechanism can be a manually-operable propulsion mechanism.

In some implementations, the rightward support device and the leftward support device are fastened to an upper portion of the hull. In some implementations, the rightward support device and the leftward support device are fastened to the upper portion of the hull via threaded fasteners.

In some implementations, an upper portion of the hull includes a first upward facing surface to abut an upper portion of the rightward support device and a second upwardly-directed surface to abut an upper portion of the leftward support device.

In some implementations, the support assembly further includes a forward support device attached to the hull and at least partially defining the forward portion of the opening. In some implementations, the forward support device includes an upwardly-directed surface to abut a forward portion of the propulsion mechanism when the propulsion mechanism is mounted to the support assembly. In some implementations, the support assembly further includes a rear support assembly attached to the hull and at least partially defining the rear portion of the opening. In some implementations, the forward support device and the rear support assembly are fastened to the hull. In some implementations, the hull includes a forward slot to receive the forward support device. In some implementations, the hull includes an inner surface at least partially defining the opening, the forward slot being recessed relative to the inner surface. In some implementations, the forward slot is recessed relative to a top surface of the hull.

In some implementations, the rightward support device includes an upper portion and a lower portion. An upper portion and a lower portion of the hull can be at least partially positioned between the upper portion of the rightward support device and the lower portion of the rightward support device. In some implementations, the leftward support device includes an upper portion and a lower portion. The upper portion and the lower portion of the hull can be at least partially positioned between the upper portion of the leftward support device and the lower portion of the leftward support device. In some implementations, the upper portion of the rightward support device and the lower portion of the rightward support device are integral with one another. In some implementations, the upper portion of the rightward support device and the lower portion of the leftward support device are separated by a gap. The upper portion and the lower portion of the hull can extend into the gap. In some implementations, the rightward support device includes a connection member connecting the upper portion and the lower portion of the rightward support device, the connection member being integral with the upper portion and the lower portion of the rightward support device. In some implementations, the upper portion, the lower portion, and the connection member are part of a single component formed in a molding process. In some implementations, the upper portion of the rightward support device is a top member of the rightward support device, and the lower portion of the rightward support device is a bottom member of the rightward support device. The top member and the bottom member of the rightward support device can be distinct from one another. In some implementations, the upper portion and the lower portion of the hull include flanges positioned between the upper portion and the lower portion of the rightward support device. In some implementations, the rightward support device is fastened to the flanges. In some implementations, the rightward support device is fastened to the flanges via one or more threaded fasteners extend through the lower portion of the rightward support device, through the hull, and through the upper portion of the rightward support device.

In some implementations, an upper portion of the hull includes a rightward slot to receive the rightward support device. The rightward slot can taper downwardly along the upper portion of the hull.

In some implementations, the rightward support device and the hull are fixed to one another via an insert-molding process.

In another aspect, a watercraft includes a hull an opening extending vertically through the hull, and a support assembly at least partially defining the opening. The support assembly is configured to mount a propulsion mechanism to the watercraft. The support assembly includes an upper flange to engage with an upper portion of the hull and a lower flange to engage with a lower portion of the hull, wherein the upper flange is bonded to the hull.

In some implementations, the upper flange forms a continuous loop. The upper flange can be bonded to the hull along an entirety of the continuous loop.

In some implementations, the upper flange forms a continuous loop. The upper flange can be bonded to the hull along at least 50% of the continuous loop.

In some implementations, the support assembly includes a body extending between the upper flange and the lower flange. The body at least partially can define the opening.

In some implementations, a dimension of the opening along a fore-aft axis of the watercraft is longer than a dimension of the opening along a left-right axis of the watercraft.

In some implementations, the support assembly includes a first bearing surface on a rightward portion of the support assembly and a second bearing surface on a leftward portion of the support assembly to mount a shaft of the propulsion mechanism to the watercraft. In some implementations, the support assembly further includes a locking mechanism to releasably lock the shaft of the propulsion mechanism to the watercraft when the propulsion mechanism is mounted to the support assembly. In some implementations, the locking mechanism is positioned on a rear portion of the support assembly. In some implementations, the locking mechanism includes a first lever including a first cam surface to engage the shaft of the propulsion mechanism when the propulsion mechanism is mounted to the support assembly, and a second lever including a second cam surface to engage the shaft of the propulsion mechanism when the propulsion mechanism is mounted to the support assembly. The first lever can be rotatably mounted to the rightward portion of the support assembly. The second lever can be rotatably mounted to the leftward portion of the support assembly.

In some implementations, a forward portion of the opening is defined by an upwardly-directed surface of the support assembly to abut a forward portion of the propulsion mechanism when the propulsion mechanism is mounted to the support assembly. In some implementations, a rearward portion of the opening is defined by an upwardly-directed surface of the support assembly to abut a rear portion of the propulsion mechanism when the propulsion mechanism is mounted to the support assembly.

In some implementations, an upper portion of the hull is welded to a lower portion of the hull along a periphery of the hull.

In some implementations, the watercraft further includes the propulsion mechanism. The propulsion mechanism can be a manually-operable propulsion mechanism.

In some implementations, the support assembly is chemically welded to the hull.

In some implementations, the support assembly is bonded to the hull via heat or pressure provided during a molding process. In some implementations, the upper flange includes one or more channels to engage with the hull during the molding process.

In some implementations, the support assembly is bonded to the hull during an insert molding process.

In another aspect, a watercraft includes a hull, an opening extending vertically through the hull, and a support assembly at least partially defining the opening. The support assembly is configured to mount a propulsion mechanism to the watercraft. The support assembly includes an upper member including an upper flange to engage with an upper portion of the hull and a lower member including a lower flange to engage with a lower portion of the hull. The upper member and the lower member are bonded to one another.

In some implementations, the support assembly includes a body extending between the upper flange and the lower flange. The body can at least partially define the opening.

In some implementations, the support assembly includes a boss that mates with a channel. One of the boss and the channel can be on the upper member, and the other of the boss and the channel can be on the lower member.

In some implementations, the watercraft further includes an adhesive to bond the upper member to the lower member.

In some implementations, a dimension of the opening along a fore-aft axis of the watercraft is longer than a dimension of the opening along a left-right axis of the watercraft.

In some implementations, the support assembly includes a first bearing surface on a rightward portion of the support assembly and a second bearing surface on a leftward portion of the support assembly to mount a shaft of the propulsion mechanism to the watercraft. In some implementations, the watercraft further includes a locking mechanism to releasably lock the shaft of the propulsion mechanism to the watercraft when the propulsion mechanism is mounted to the support assembly. In some implementations, the locking mechanism includes a first lever including a first cam surface to engage the shaft of the propulsion mechanism when the propulsion mechanism is mounted to the support assembly, and a second lever including a second cam surface to engage the shaft of the propulsion mechanism when the propulsion mechanism is mounted to the support assembly. The first lever can be rotatably mounted to the rightward portion of the support assembly. The second lever can be rotatably mounted to the leftward portion of the support assembly.

In some implementations, a forward portion of the opening is defined by an upwardly-directed surface of the support assembly to abut a forward portion of the propulsion mechanism when the propulsion mechanism is mounted to the support assembly. In some implementations, a rearward portion of the opening is defined by an upwardly-directed surface of the support assembly to abut a rear portion of the propulsion mechanism when the propulsion mechanism is mounted to the support assembly.

Advantages of implementations described in this disclosure may include those described below and elsewhere in this disclosure. The support assemblies allow for watercraft to be more modular, thus allowing different types of propulsion mechanisms to be mounted to the watercraft at different times. In some implementations, the support assemblies are easier to manufacture, are lighter weight, or require less labor for installation. For example, the support assembly can be easier to attach to the hull in a molding operation rather than through fasteners. The support assembly can include smaller components and therefore more easily handled when being attached to the hull. In some implementations, the support assemblies are more easily replaceable, thus making repair of the watercraft more efficient.

The details of one or more implementations of the subject matter described in this specification are set forth in the accompanying drawings and the description below. Other potential features, aspects, and advantages will become apparent from the description, the drawings, and the claims.

DETAILED DESCRIPTION

Figure 1A:
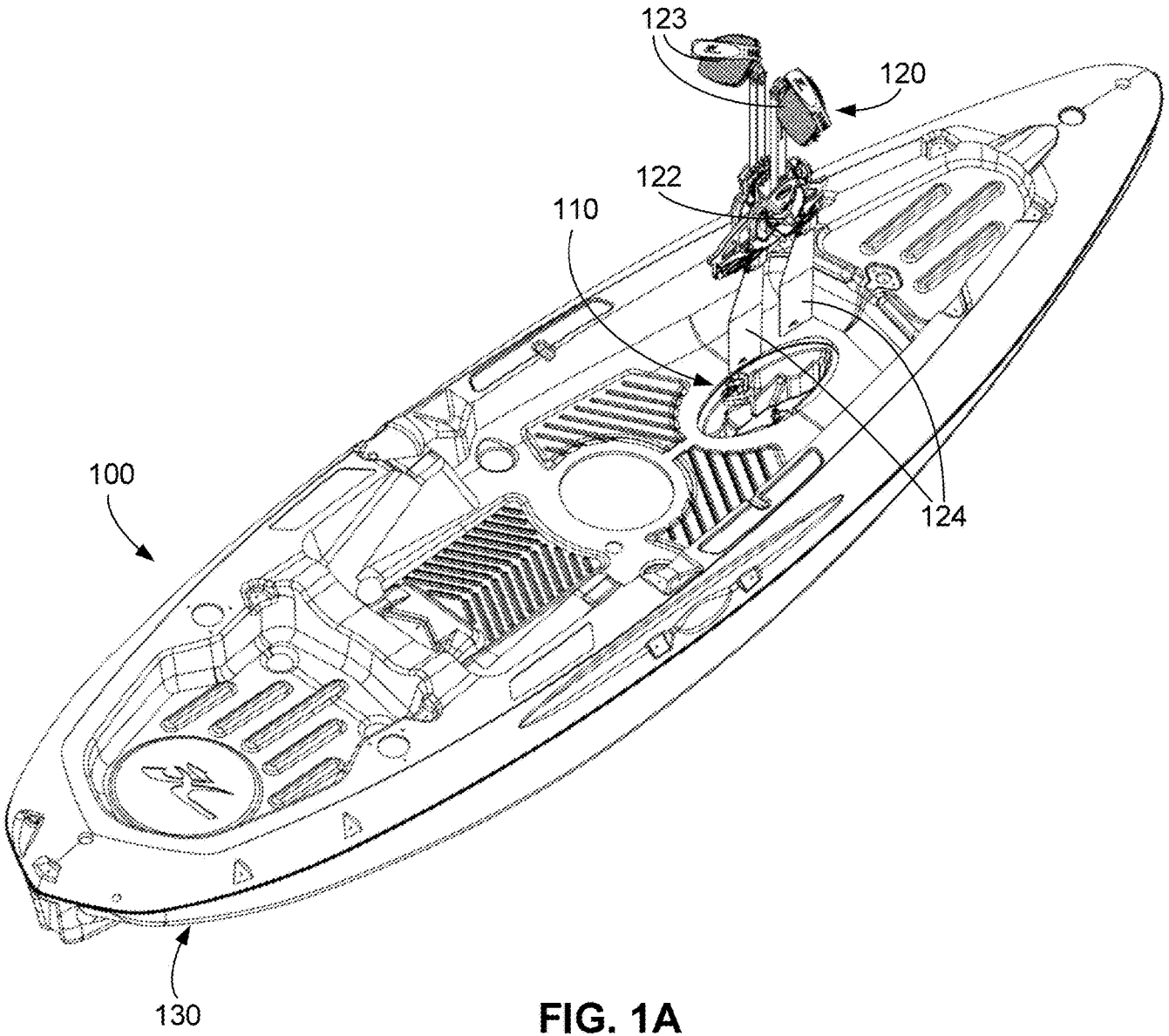
FIGS. 1A-1B are top perspective views of a watercraft with a propulsion mechanism dismounted and mounted, respectively.
Figure 1B:
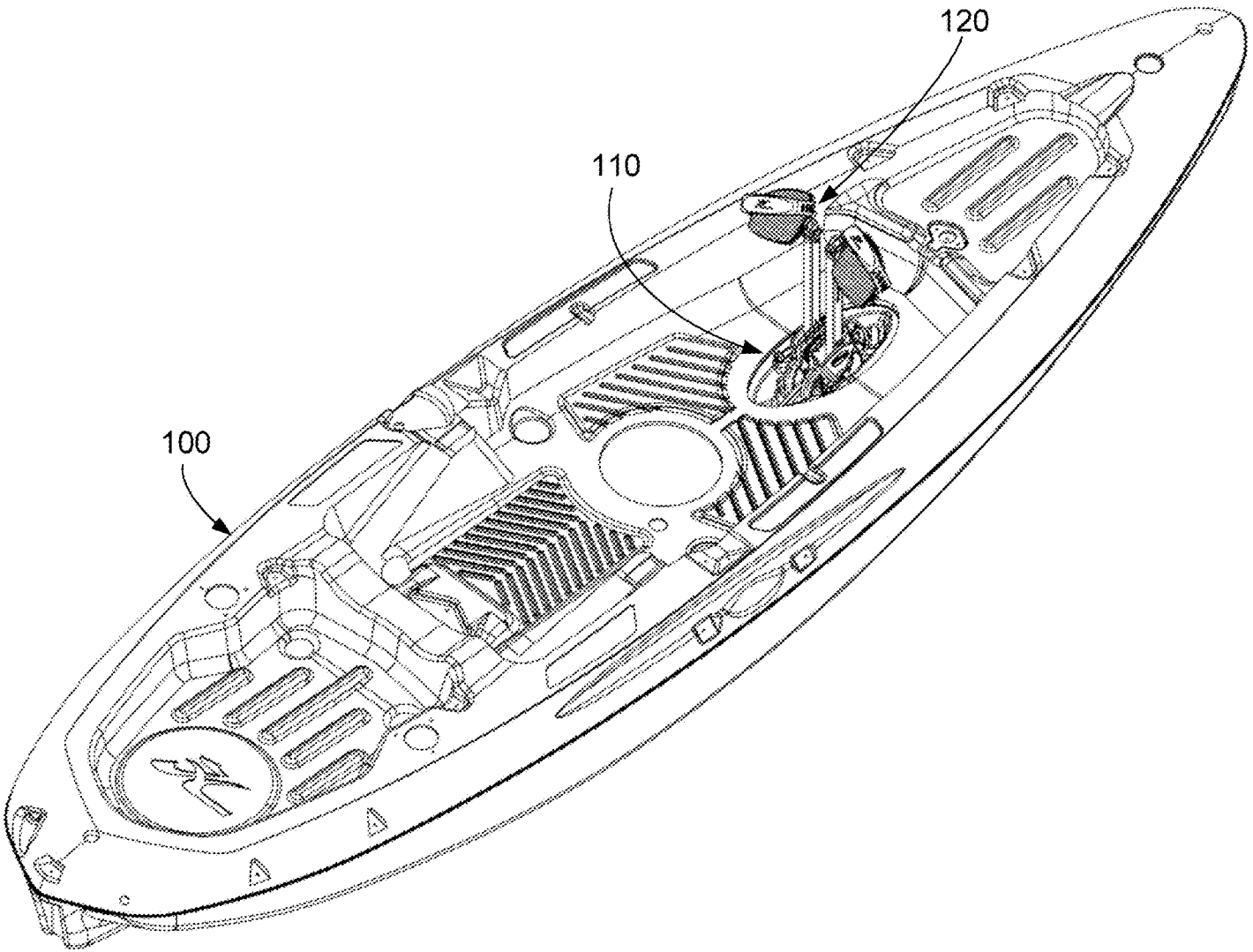

As illustrated in FIGS. 1A-1B, an example of a watercraft 100 includes a support opening 110 to receive a propulsion mechanism 120 and mount the propulsion mechanism 120 to the watercraft 100. In the example illustrated in FIGS. 1A-1B, the watercraft 100 is a kayak, and the propulsion mechanism 120 is a manually-operable propulsion mechanism. FIG. 1A shows the watercraft 100 when the propulsion mechanism 120 is not received in the support opening 110 and thereby dismounted from the watercraft 100. FIG. 1B shows the watercraft 100 when the propulsion mechanism 120 is received in the support opening 110 and thereby mounted to the watercraft 100.

The support opening 110 is a through-opening extending vertically through an entirety of a hull 130 of the watercraft 100. As described in this disclosure, a locking mechanism within the support opening 110 can mount the propulsion mechanism 120 to the watercraft 100 when the propulsion mechanism 120 is received within the support opening 110.

When the propulsion mechanism 120 is received in the support opening 110 and mounted to the watercraft 100, a drivable portion of the propulsion mechanism 120 (e.g., pedals 123) is above the hull 130 and a driven portion of the propulsion mechanism 120 (e.g., flippers 124) are positioned below the hull 130. The propulsion mechanism 120 can be hand-operated or foot-operated. When mounted to the watercraft 100, the propulsion mechanism 120 is operable to propel the watercraft 100 when the watercraft 100 is on water. For example, in FIGS. 1A-1B, the pedals 123 can be manually operated by a human user to actuate the flippers 124, thereby propelling the watercraft 100 through water.

The support opening 110 allows for various types of modules to be easily mounted to the watercraft 100. In the example depicted in FIGS. 1A-1B, the propulsion mechanism 120 is an example of a module receivable in the support opening 110. A module includes one or more mounting members, e.g., one or more shafts such as a shaft 122 of the propulsion mechanism, for physically mounting the module in the support opening 110. The different types of modules can have housings that are shaped and dimensioned to be received in the support opening 110. The support opening 110 thus allows for easy use of drop-in modules. This disclosure discusses various implementations for providing the support opening 110 for the watercraft 100. Other devices can be mounted in the support opening 110. For example, in some implementations, a cap can be mounted in or on the support opening 110 to prevent water from spilling onto a deck of the watercraft 100. In other implementations, a drain device can be mounted in or on the support opening 110 to allow water to be drained through the support opening 110.

Figure 2A:
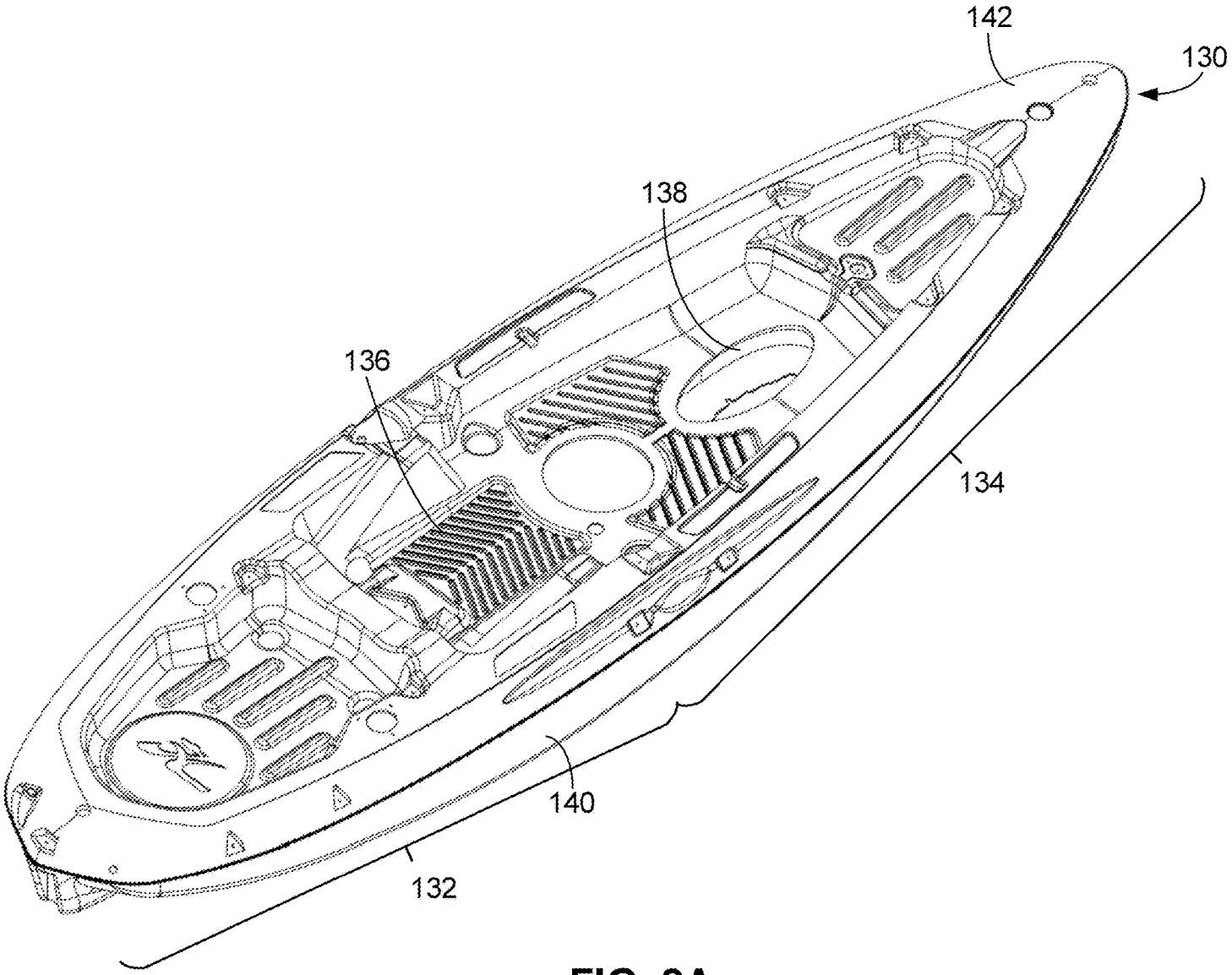
FIGS. 2A-2B are top perspective and top views of a hull of watercraft.
Figure 2B:
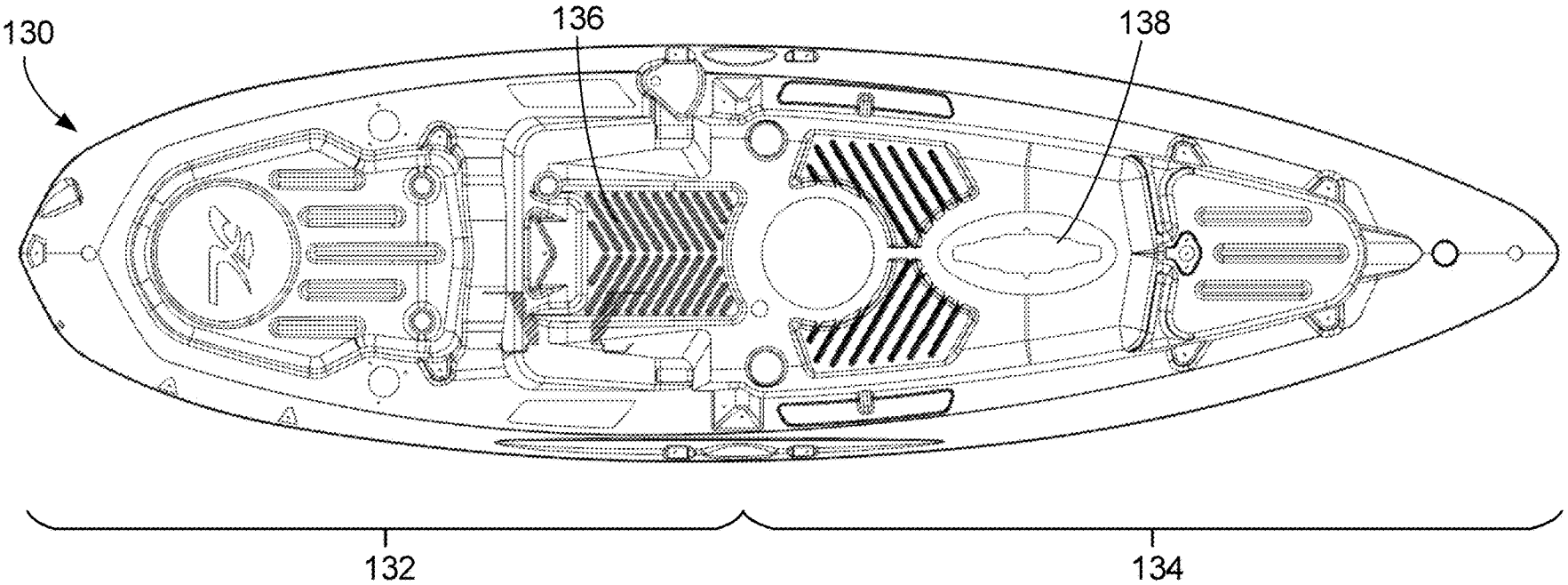

FIGS. 2A-2B illustrate an example of the hull 130 of the watercraft 100. The hull 130 of the watercraft 100 provides the overall structural support for components of the watercraft 100. The hull 130 includes a rearward portion 132 and a forward portion 134. The rearward portion 132 can support, for example, a seat 136 for a human user. The forward portion 134 of the hull 130 defines an opening 138. The opening 138 is defined only by the hull 130. As discussed in this disclosure, one or more components define the support opening 110 (shown in FIG. 1A). In some implementations, the one or more components defining the support opening 110 can include the hull 130, while in other implementations, the one or more components defining the support opening 110 do not include the hull 130. In implementations in which the one or more components include the hull 130, the opening 138 can at least partially form the support opening 110. In the example depicted in FIGS. 2A and 2B, the opening 138 is adapted to receive a support assembly 150 (shown in FIGS. 3A-3B) that in turn forms the support opening 110.

An example of the support assembly 150 is described in greater detail with respect to FIGS. 3A-3B and 4A-4D. Further examples of a support assembly that can be used in combination with the watercraft 100 are described in the examples of FIGS. 5-8, FIGS. 9-12, FIGS. 13A-15C, FIGS. 16-18B, FIGS. 19A-21C, FIGS. 22A-24, FIGS. 25-27C, FIGS. 28-30, and FIGS. 31-36 and in further implementations described in this disclosure. In these examples, at least part of the support opening is formed by a component that is integral to the hull. In some implementations, an entirety of the support opening is formed by one or more components that is integral to the hull and while in other implementations, only a portion of the support opening is formed by one or more components that is integral to the hull.

In the example of the hull 130 illustrated in FIG. 2A, the hull 130 includes an upper portion 140 and a lower portion 142. The upper portion 140 and the lower portion 142 can be formed separately and then joined together. For example, the upper portion 140 and the lower portion 142 can be each formed using separate molds in a thermoforming process, and then bonded together. The upper portion 140 and the lower portion 142 can be welded together along a periphery of the watercraft 100. The welding process can involve a physical process (e.g., pressure), a thermal process (e.g., heat), a chemical process (e.g., chemical welding), or any combination of these processes to join the upper portion 140 and the lower portion 142 together. The hull 130 can include a core, e.g., a foam core, and a polymer shell on the core.

Figure 3A:
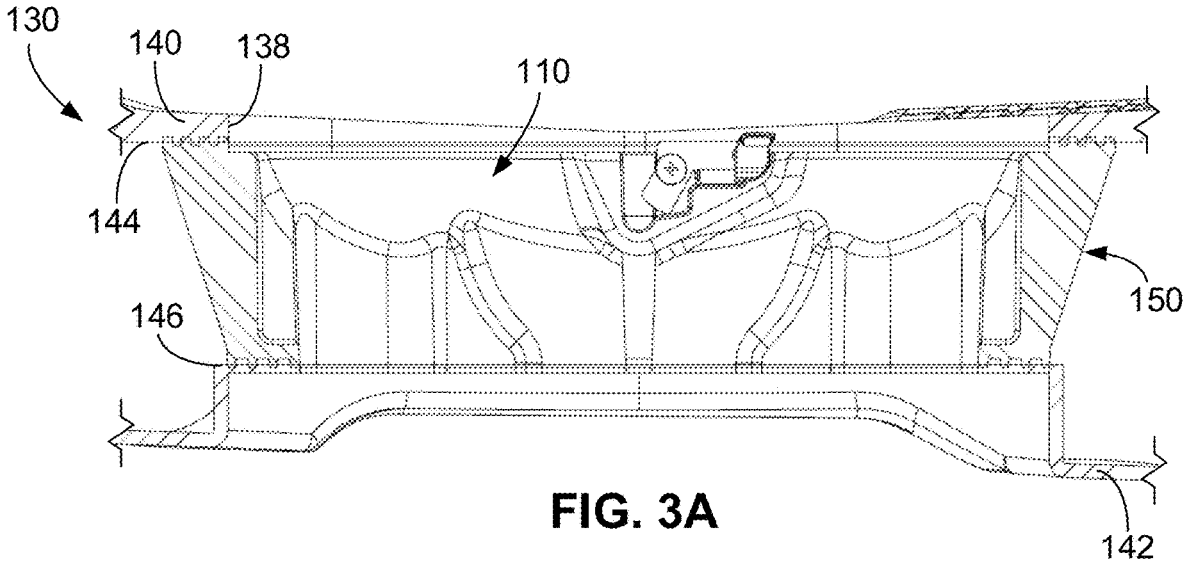
FIGS. 3A-3B are side and front cross-sectional views, respectively, of a first example of a portion of a hull and a support assembly.
Figure 3B:
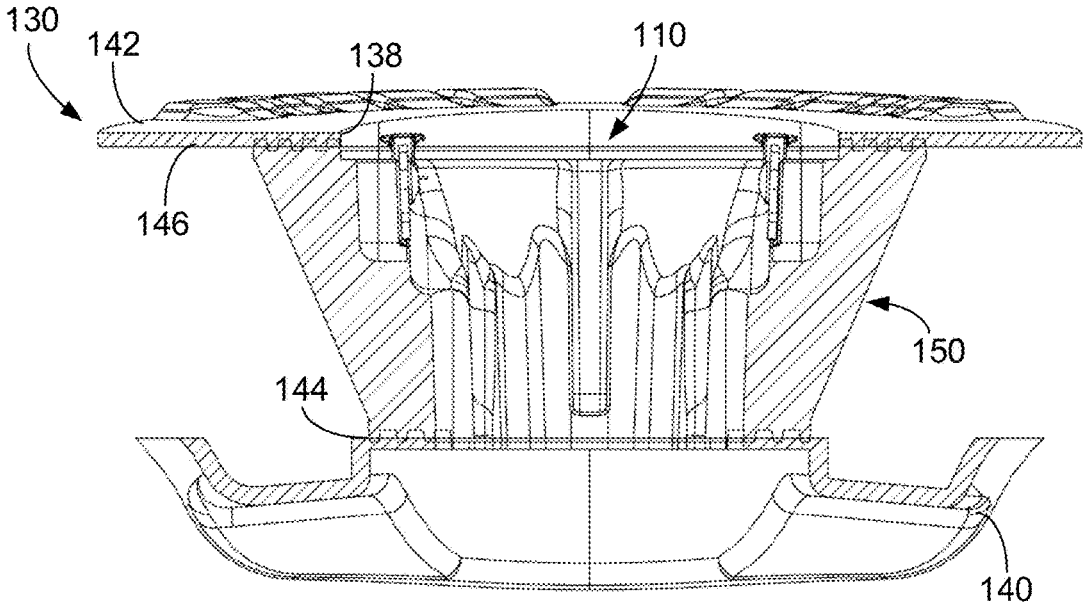

FIGS. 3A-3B illustrate a portion of the hull 130 connected to the support assembly 150 (shown in greater detail in FIGS. 4A-4D), and the support opening 110 (shown in FIG. 3B) formed by the combination of the hull 130 and the support assembly 150. For illustration purposes, only the parts of the lower portion 142 and the upper portion 140 of the hull 130 in the vicinity of the opening 138 are shown in FIGS. 3A-3B. In this regard, FIGS. 3A-3B show a portion of the hull 130 in a vicinity of the support assembly 150 and in particular, illustrates the support assembly 150 attached to the hull 130. The support assembly 150 is integral to the hull 130. The support assembly 150 is bonded to an upper surface 144 of the lower portion 142 of the hull 130, and is further bonded to a bottom surface 146 of the upper portion 140 of the hull 130. The bond between the support assembly 150 and the hull 130 is a permanent bond. As shown in FIGS. 3A-3B, the hull 130 and the support assembly 150 together define the support opening 110.

Figure 4A:
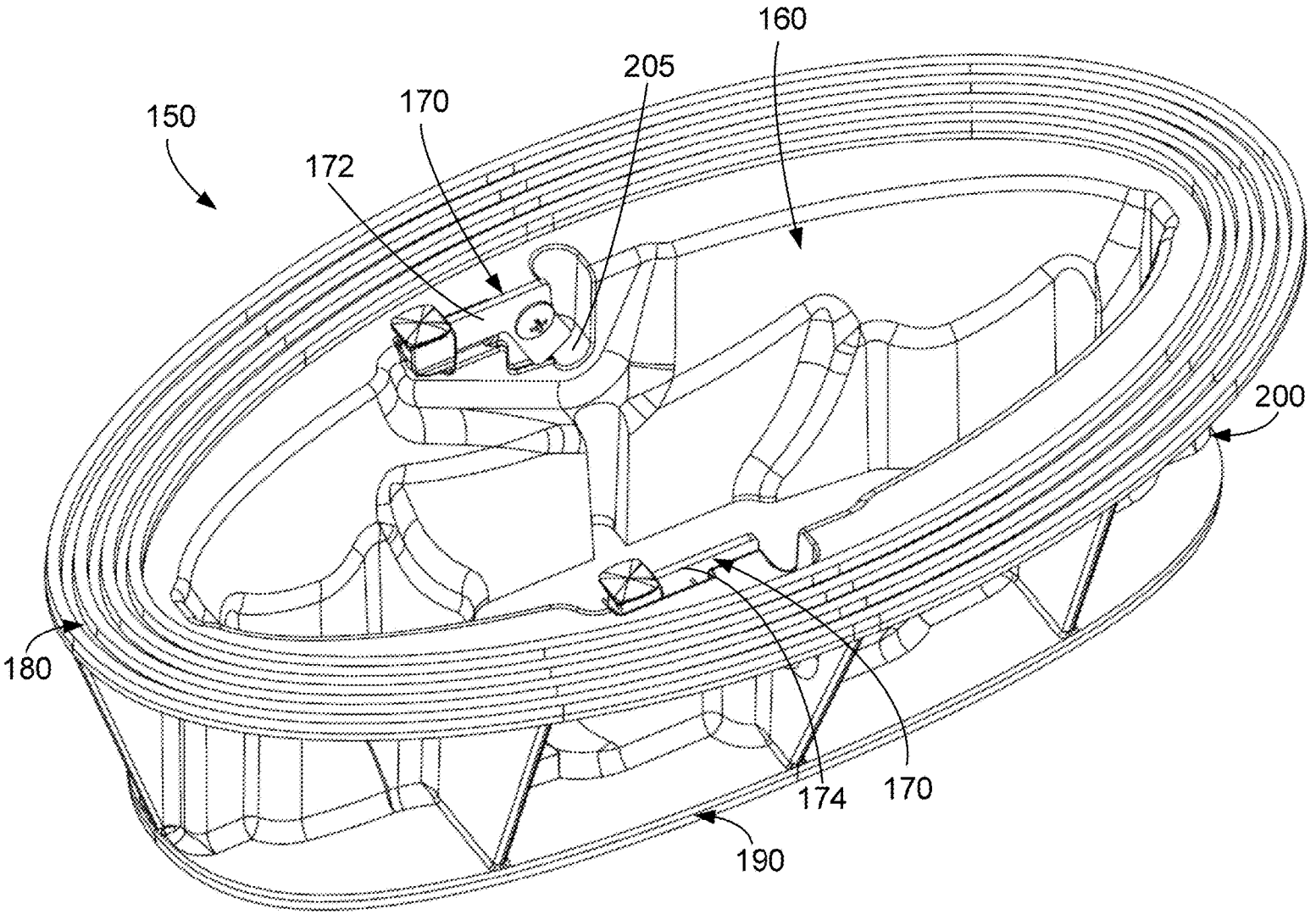
FIGS. 4A-4D are top perspective, side cross-sectional, top, and bottom views, respectively, of the support assembly of FIGS. 3A-3B.
Figure 4B:
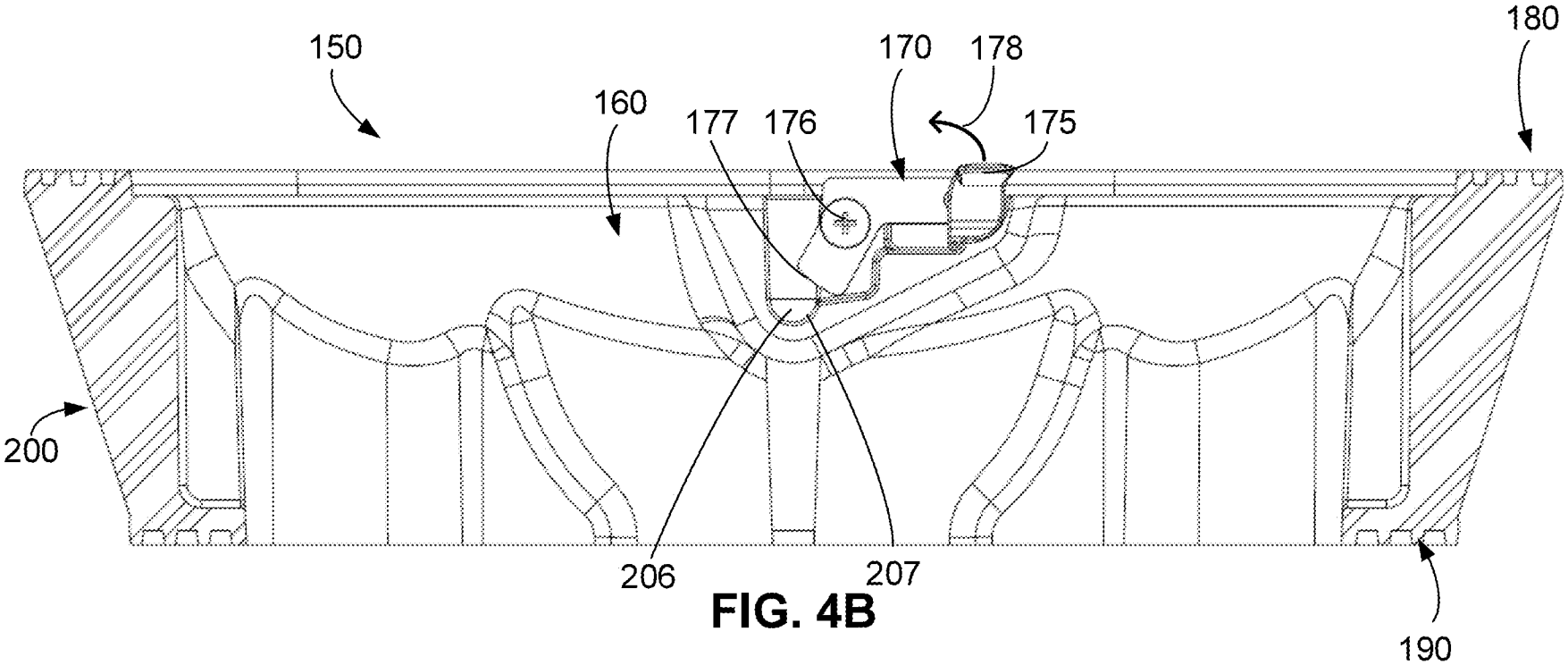

FIGS. 4A-4D illustrates an example of the support assembly 150. As illustrated in FIGS. 4A-4B, the support assembly 150 provides an opening 160 that defines, at least in part, the support opening 110 (shown in FIGS. 3A-3B) and that is configured to receive a module (e.g., the propulsion mechanism 120 shown in FIGS. 1A-1B). A locking mechanism 170 attached to the support assembly 150 can lock the module to the support assembly 150 and thereby mount the module to the hull 130 (shown in FIGS. 3A-3B). The support assembly 150 includes an upper flange 180, a lower flange 190, and a body 200 extending between the upper flange 180 and the lower flange 190.

The opening 160 is a through-opening extending vertically through an entire height of the support assembly 150. The opening 160 is defined by inner surfaces of the support assembly 150, e.g., inner surfaces of the upper flange 180, the lower flange 190, and the body 200. The opening 160, in combination with the opening 138 of the hull 130 (shown in FIGS. 3A-3B) defines the support opening 110.

Figure 4C:
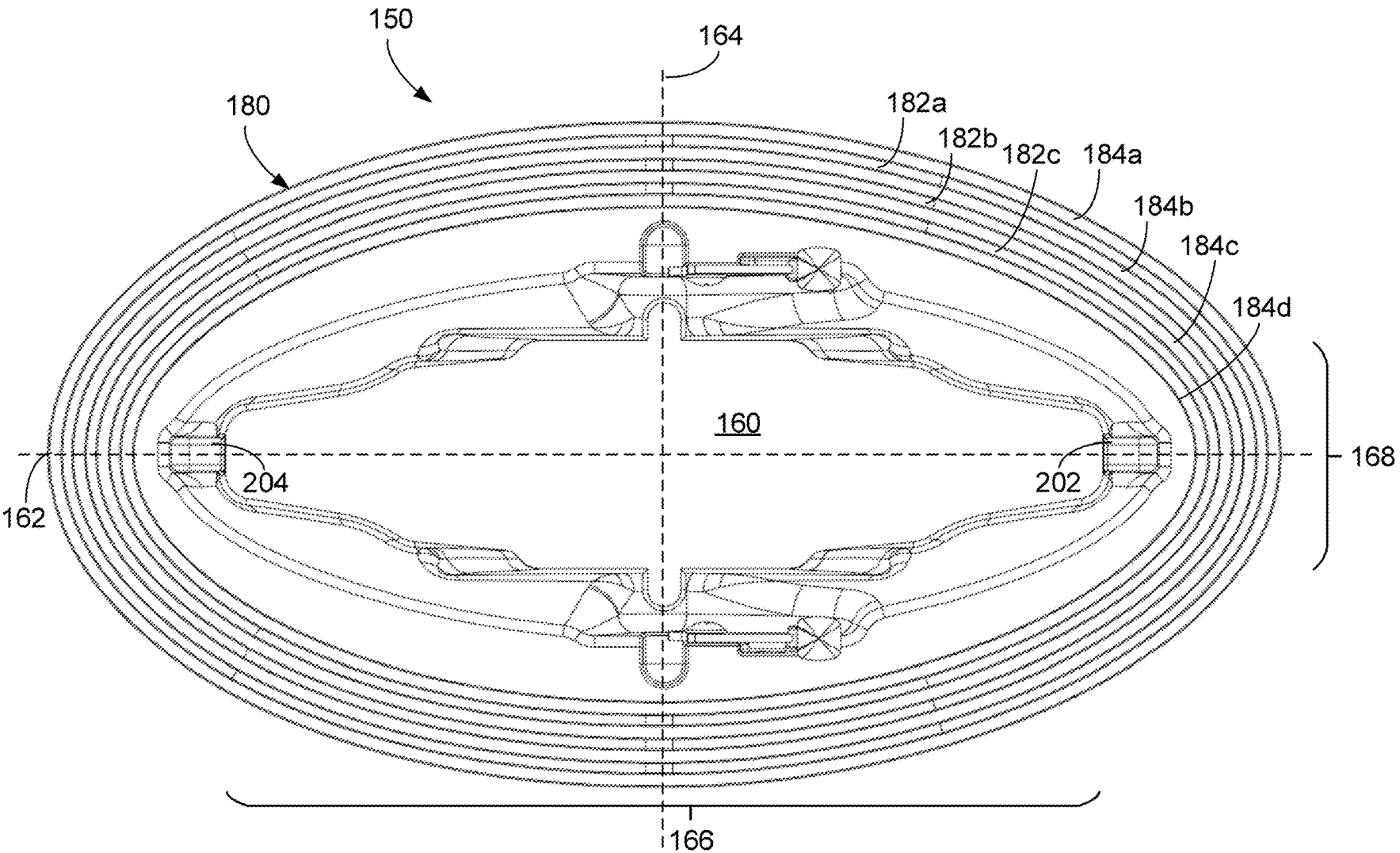

As shown in FIG. 4C, the opening 160 extends along a fore-aft axis 162 and a left-right axis 164. A dimension 166 of the opening 160 extends along the fore-aft axis 162, and a dimension 168 of the opening 160 extends along the left-right axis 164. In the example illustrated in FIG. 4C, the dimension 166 is greater than the dimension 168, i.e., the dimension 166 is a length and the dimension 168 is a width.

The fore-aft axis 162 and the left-right axis 164 also correspond to axes for the support opening 110. In this regard, a dimension of the support opening 110 along the fore-aft axis 162 (e.g., a length of the support opening 110) can be greater than a dimension of the support opening 110 along the left-right axis 164 (e.g., a width of the support opening 110).

As shown in FIG. 4A, the locking mechanism 170 includes a lever 172 rotatably mounted on a leftward portion of the support assembly 150, and a lever 174 rotatably mounted on a rightward portion of the support assembly 150. In implementations, the lever 172 and the lever 174 can be separately operable, with the lever 172 being symmetric relative to the lever 174 about the fore-aft axis 162. Detailed features of the lever 174 on the rightward portion of the support assembly 150 are described in this disclosure, and these features are applicable to the lever 172 in implementations.

As shown in FIG. 4B, the lever 174 is rotatable about a pin 176 and includes a manually-operable portion 175 and a cam surface 177. The manually-operable portion 175 can be operated by a human user (e.g., using a hand) to move the lever 174 about the pin 176. This in turn causes the cam surface 177 to move. The cam surface 177 engages with a shaft 122 (shown in FIG. 1A) of the propulsion mechanism 120 to releasably lock the propulsion mechanism to the support assembly 150. The manually-operable portion 175 can be operated to rotate the lever 174 in a direction 178 to disengage the cam surface 177 from the shaft 122. As shown in FIG. 4A, the lever 172 can rotate about a corresponding pin and can include a corresponding manually-operable portion and a corresponding cam surface having features similar to those described with respect to the lever 174.

The shaft 122 is received in a slot 205 (shown in FIG. 4A) on the rightward portion of the support assembly 150 and a slot 206 (shown in FIG. 4B) on the leftward portion of the support assembly 150. The slots 205, 206 include bearing surfaces on which the shaft 122 is supported. For example, as shown in FIG. 4B, the slot 205 on the rightward portion of the support assembly 150 is at least partially defined by a rounded bearing surface 207 to receive the shaft 122.

The body 200 of the support assembly 150 can include surfaces to support the propulsion mechanism 120 when the propulsion mechanism is received in the support opening 110. Referring to FIG. 4C, the body 200 includes an upwardly-directed surface 202 in a forward portion of the support assembly 150 and hence in a forward portion of support opening 110. The body 200 further includes an upwardly-directed surface 204 in a rearward portion of the support assembly 150 and hence in a rearward portion of the support opening 110. The upwardly-directed surfaces 202, 204 are positioned at a periphery of the support opening 110 and are aligned with the fore-aft axis 162 of the opening 160. These surfaces 202, 204 are configured to support the propulsion mechanism when the propulsion mechanism 120 to the support assembly 150. In particular, the upwardly-directed surface 202 abuts a forward portion of the propulsion mechanism 120, and the upwardly-directed surface 204 abuts a rearward portion of the propulsion mechanism 120. When the propulsion mechanism 120 is mounted to the support assembly 150 and is used, the upwardly-directed surfaces 202, 204 can support downward forces on the propulsion mechanism 120 that are transmitted through the propulsion mechanism 120 to the support assembly 150, and thereby to the hull 130.

As shown in FIG. 4C, the upper flange 180 forms a continuous loop on top of the support assembly 150. The upper flange 180 includes one or more channels extending continuously about the continuous loop and one or more raised portions extending continuously about the continuous loop. In the example shown in FIG. 4C, the upper flange 180 includes three channels 182*a*, 182*b*, 182*c* adjacent to four raised portions 184*a*, 184*b*, 184*c*, 184*d*. The bottom surfaces defining the channels 182*a*, 182*b*, 182*c* can be coplanar with one another, and the top surfaces defining the raised portions 184*a*, 184*b*, 184*c*, 184*d* can be coplanar with one another. The channels 182*a*, 182*b*, 182*c* and the raised portions 184*a*, 184*b*, 184*c*, 184*d* are alternately arranged. In further implementations, any number of channels and raised portions can be used. For example, in some implementations, the number of channels is 1, 2, 3, 4, or more, and the number of raised portions is 1, 2, 3, 4, or more.

Figure 4D:
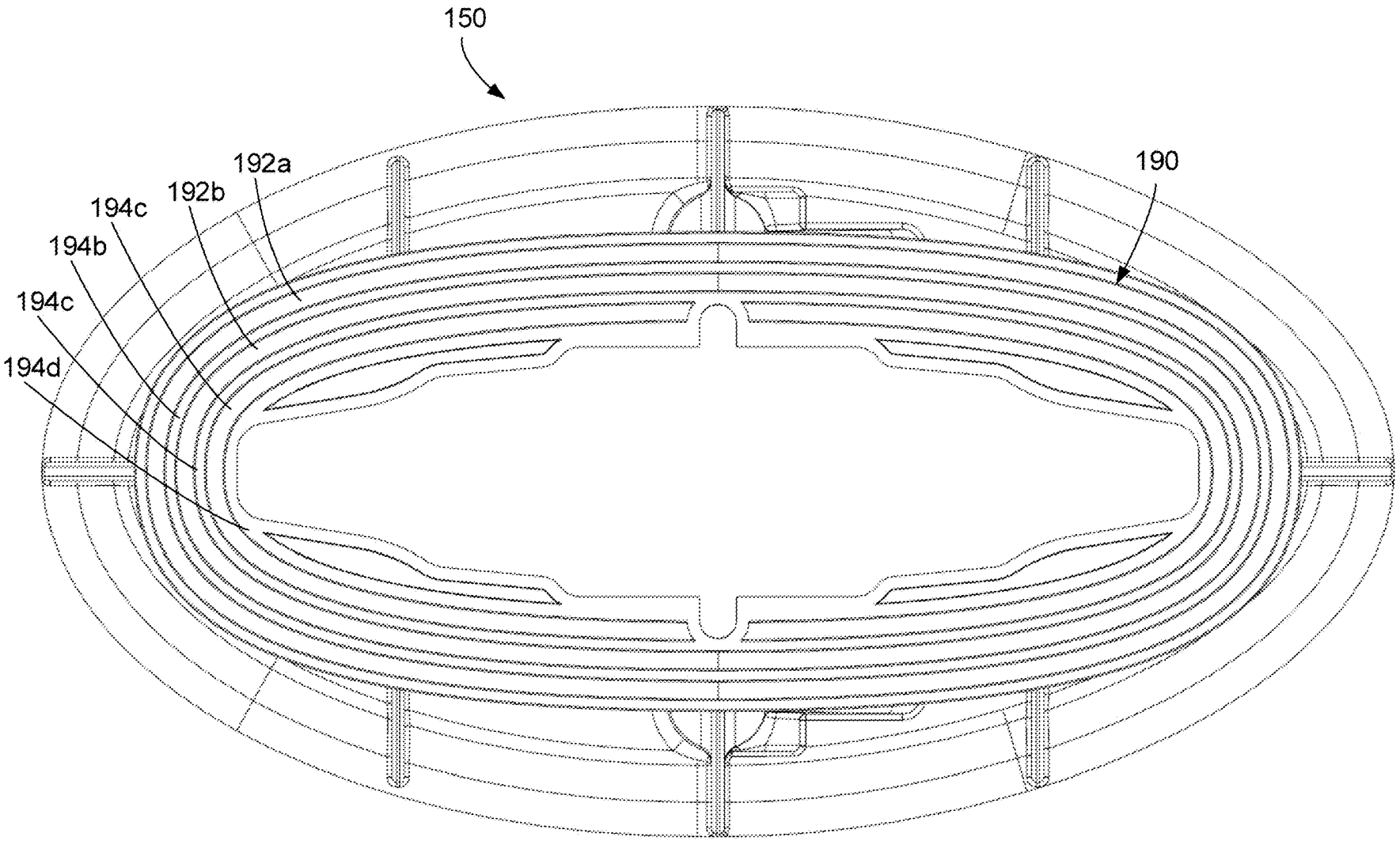

As shown in FIG. 4D, the lower flange 190 can include similar features. The lower flange 190 includes one or more channels extending continuously about the continuous loop and one or more raised portions extending continuously about the continuous loop. In the example shown in FIG. 4C, the lower flange 190 includes three channels 192*a*, 192*b*, 192*c* adjacent to four raised portions 194*a*, 194*b*, 194*c*, 194*d*. The top surfaces defining the channels 182*a*, 182*b*, 182*c* can be coplanar with one another, and the bottom surfaces defining the raised portions 184*a*, 184*b*, 184*c*, 184*d* can be coplanar with one another. The channels 192*a*, 192*b*, 192*c* and the raised portions 194*a*, 194*b*, 194*c*, 194*d* are alternately arranged.

During a manufacturing and assembly process for the hull 130 and the support assembly 150, the hull 130 and the support assembly 150 are formed using different molds. The upper portion 140 and the lower portion 142 of the hull 130 using different molds, and the support assembly 150 can be formed using another mold. To form molded components, a thermoforming process can be used. In other implementations, a rotational molding, an injection molding, or other appropriate mold-based process can be used. The hull 130 and the support assembly 150 can be formed of the same polymer, e.g., polyethylene. Other types of polymers are possible in implementations.

In the assembly process for the hull 130 and the support assembly 150, the hull 130 and the support assembly 150 can be bonded to one another. For example, the upper flange 180 of the support assembly 150 can be bonded to the bottom surface 146 of the upper portion 140 of the hull 130, and the lower flange 190 of the support assembly 150 can be bonded to the upper surface 144 of the lower portion 142 of the hull 130. The welding process can involve a physical process (e.g., pressure), a thermal process (e.g., heat), a chemical process (e.g., chemical welding), or any combination of these processes to join the support assembly 150 to the hull 130. For example, in some implementations, the support assembly 150 is formed in a molding process and then is placed between the upper portion 140 of the hull 130 and the lower portion 142 of the hull 130. This placement can occur after the formation of the upper portion 140 and the lower portion 142 in their respective molding processes. The support assembly 150 can be heated, and then pressure can be used to engage the upper flange 180 of the support assembly 150 with the upper portion 140 of the hull 130, and to engage the lower flange 190 of the support assembly with the lower portion 142 of the hull 130. A temperature of the support assembly 150 can be below the melting temperature of the material forming the support assembly 150.

In some implementations of the manufacturing process, the upper portion 140 of the hull 130 and the lower portion 142 of the hull 130 can be positioned in their respective molds at an end of the molding operations. The upper and lower portions 140, 142 could be formed in blow-molding operations. The support assembly 150 can be formed in an injection molding operation. A press can be used to move the molds toward one another and thereby move the upper portion 140 and the lower portion 142 toward one another. The support assembly 150 can be positioned between the upper portion 140 and the lower portion 142 such that, as the upper portion 140 and the lower portion 142 are brought together, the upper and lower portions 140, 142 of the hull 130 contact the support assembly 150. Because the support assembly 150 is heated, the pressure applied to the support assembly 150 can cause portions of the support assembly 150, e.g., the one or more raised portions 184*a*-184*c* and other parts of the upper and lower flanges 190 of the support assembly 150, to deform and weld to the upper and lower portions 140, 142 of the hull 130. The press can be controlled to cause the upper and lower portions 140, 142 to move to a predetermined distance relative to one another. The distance can correspond to a sum of the thicknesses of the upper and lower portions 140, 142 of the hull 130, or can be less than this sum, e.g., 75% to 95% of the sum. The press alternatively can be pressure-controlled. The pressure provided by the press can be between 1000 psi and 4000 psi, e.g., between 1500 and 3500 psi, between 1500 and 2500 psi, between 2000 and 3000 psi, about 2000 psi, about 2500 psi, between 75 and 275 bars, between 6.5 and 27.5 MPa, etc.

The combination of the heat and the pressure can cause the support assembly 150 to join the hull 130. In particular, the channels and raised portions of the upper and lower flanges 180, 190 can melt and thereby form a weld between the hull 130 and the rest of the support assembly 150. In some implementations, the upper and lower flanges 180, 190 are bonded to the upper and lower portions 140, 142 of the hull 130 along at least 50% of the respective continuous loops formed by the upper and lower flanges 180, 190 of the support assembly 150, e.g., at least 75%, at least 80%, at least 85%, at least 90%, at least 95%, or an entirety of the continuous loop.

In addition, the operation of moving the upper and lower portions 140, 142 toward one another can weld the upper and lower portions 140, 142 at a periphery of the hull 130. In this regard, the operation to weld the upper and lower portions 140, 142 to the support assembly 150 and the operation to weld the upper and lower portions 140, 142 to one another both can occur as the upper and lower portions 140, 142 are brought together by the press. These welds can thus be formed simultaneously.

Figure 5:
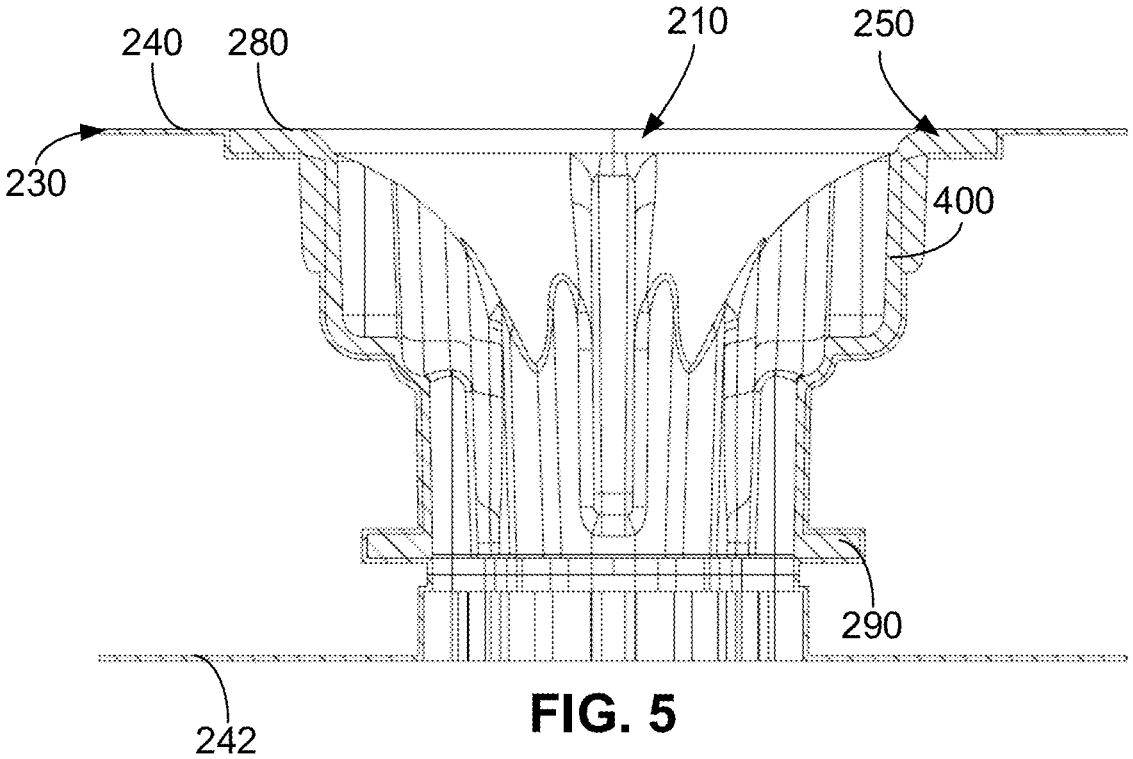
FIG. 5 is a front cross-sectional view of a further example of a portion of a hull and a support assembly.
Figure 6:
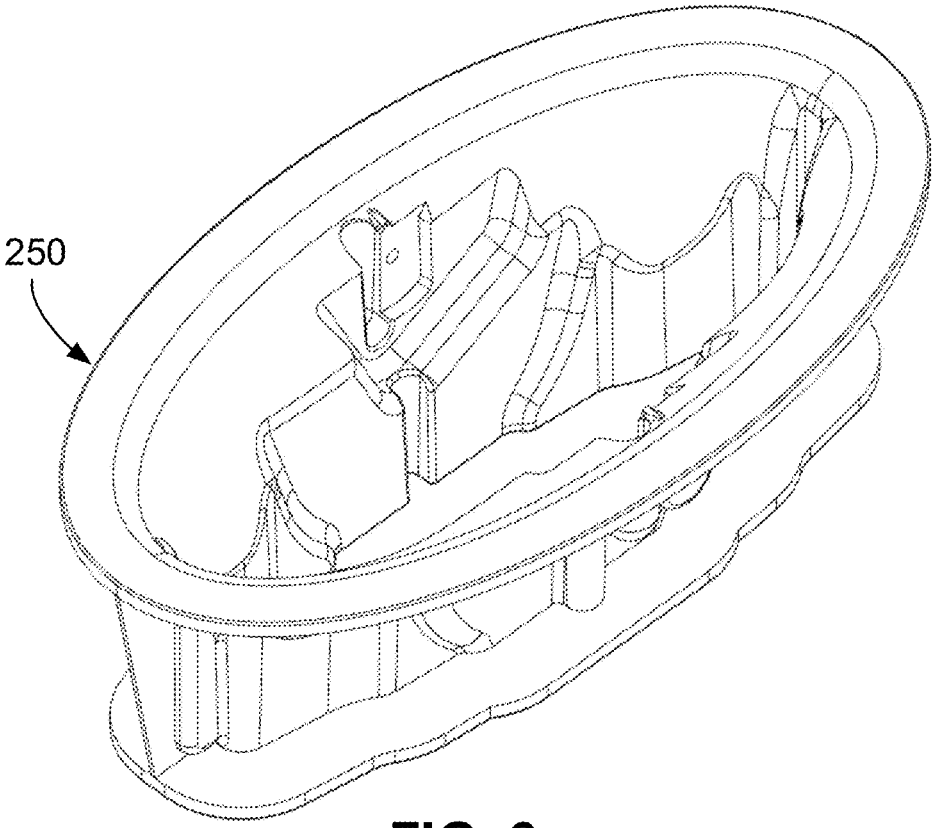
FIG. 6 is a top perspective view of the support assembly of FIG. 5.

FIGS. 5-6 illustrate a further example of a support opening 210, a portion of a hull 230, and a support assembly 250 in which the support assembly 250 is insert-molded to the hull 230 during a molding process for the hull 230. FIG. 5 illustrates the support assembly 250 attached to the hull 230. FIGS. 5-6 show a portion of the hull 230 in a vicinity of the support assembly 250 and in particular, illustrates the support assembly 250 attached to the hull 230. The support opening 210, the hull 230, and the support assembly 250 include features similar to those discussed with respect to the support opening 110, the hull 130, and the support assembly 150. The support opening 210, the hull 230, and the support assembly 250 differ from the support opening 110, the hull 130, and the support assembly 150 in certain respects.

The hull 230 includes an upper portion 240 and a lower portion 242 similar to the upper portion 140 and the lower portion 142. In the implementations described with respect to FIGS. 2A-4D, the upper portion 140 and the lower portion 142 of the hull 130 are attached to one another along a periphery of the hull 130. In addition, the upper portion 140 and the lower portion 142 are each attached to the support assembly 150, thereby connecting the upper portion 140 and the lower portion 142 through the support assembly 150.

In FIG. 5, rather than being connected through the support assembly 250 (e.g., as is the case for the upper portion 140 and the lower portion 142), the upper portion 240 and the lower portion 242 of the hull 230 are directed connected to one another in a vicinity of the support assembly 250. In particular, the support assembly 250 is attached to the hull 230 in an insert molding process that causes the upper portion 240 and the lower portion 242 to form around the support assembly 250 and bond to the support assembly 250. The implementations described with respect to FIGS. 31-36 are examples of insert-molding processes for forming the support assembly 250 on the hull 230. As shown in FIG. 5, the upper portion 240 of the hull 230 and the lower portion 242 of the hull 230 engage with the support assembly 250 along an entire height of the support assembly 250. Specifically, the upper portion 240 of the hull 230 bonds to a lower surface and a side surface of an upper flange 280 of the support assembly 250 and along side surfaces of a body 400 of the support assembly 250, and the lower portion 242 of the hull 230 bonds to upper, side, and lower surfaces of a lower flange 290 of the support assembly 250. These bonds are formed during the insert molding process.

FIG. 6 provides a detailed view of the support assembly 250. A locking mechanism for the support assembly 250 is not shown. The locking mechanism can be similar to other examples of locking mechanisms described in this disclosure, e.g., the locking mechanism 170. The support assembly 250 includes features similar to those described with respect to the support assembly 150 except that the support assembly 250 does not include one or more channels and one or more raised portions along the upper and lower flanges 280, 290.

Figure 7:
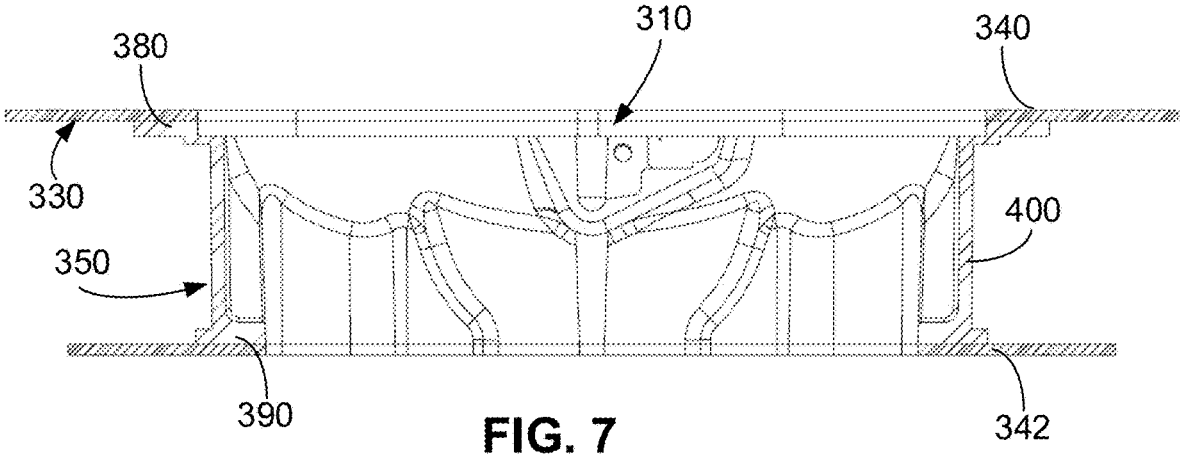
FIG. 7 is a front cross-sectional view of a further example of a portion of a hull and a support assembly.
Figure 8:
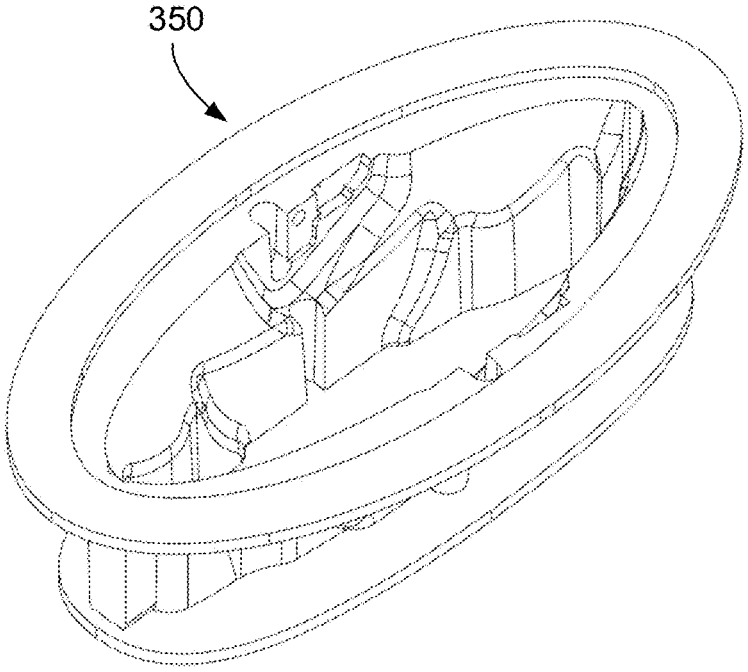
FIG. 8 is a top perspective view of the support assembly of FIG. 7.

FIGS. 7-8 illustrate a further example of a support opening 310, a hull 330, and a support assembly 350 in which the support assembly 350 is chemically welded to the hull 330. FIG. 7 illustrates the support opening 310, the hull 330, and the support assembly 350. FIGS. 7-8 show a portion of the hull 330 in a vicinity of the support assembly 350 and in particular, illustrates the support assembly 350 attached to the hull 330. The support opening 310, the hull 330, and the support assembly 350 include features similar to those discussed with respect to the support opening 110, the hull 130, and the support assembly 150. The support opening 310, the hull 330, and the support assembly 350 differ from the support opening 110, the hull 130, and the support assembly 150 in certain respects.

The example represented in FIG. 7 is similar to the implementations described with respect to FIGS. 2A-4D in that the upper portion 340 and the lower portion 342 are connected to in a vicinity of the support assembly 350 through the support assembly 350. In particular, each of the upper portion 340 and the lower portion 342 of the hull 330 are connected to the support assembly 350. An upper flange 380 of the support assembly 350 is connected to the upper portion 340 of the hull 330, and a lower flange 390 of the support assembly 350 is connected to the lower portion 342 of the hull 330. The upper flange 380 and the lower flange 390 are chemically welded to the upper portion 340 and the lower portion 342, respectively. For example, an adhesive can be placed on the upper flange 380 and the lower flange 390 and/or on the surfaces of the upper and lower portions 340, 342 of the hull 330. The upper flange 380 and the upper portion 340 are brought together, and the lower flange 390 and the lower portion 342 are brought together. The adhesive can then adhere the hull 330 and the support assembly 350 to one another. The hull 330 and the support assembly 350 can be formed of the same polymer, e.g., polyethylene. Other types of polymer are possible in implementations.

FIG. 8 provides a detailed view of the support assembly 350. The support assembly 350 includes features similar to those described with respect to the support assembly 150 except that the support assembly 350 does not include one or more channels and one or more raised portions along the upper and lower flanges 380, 390.

Figure 9:
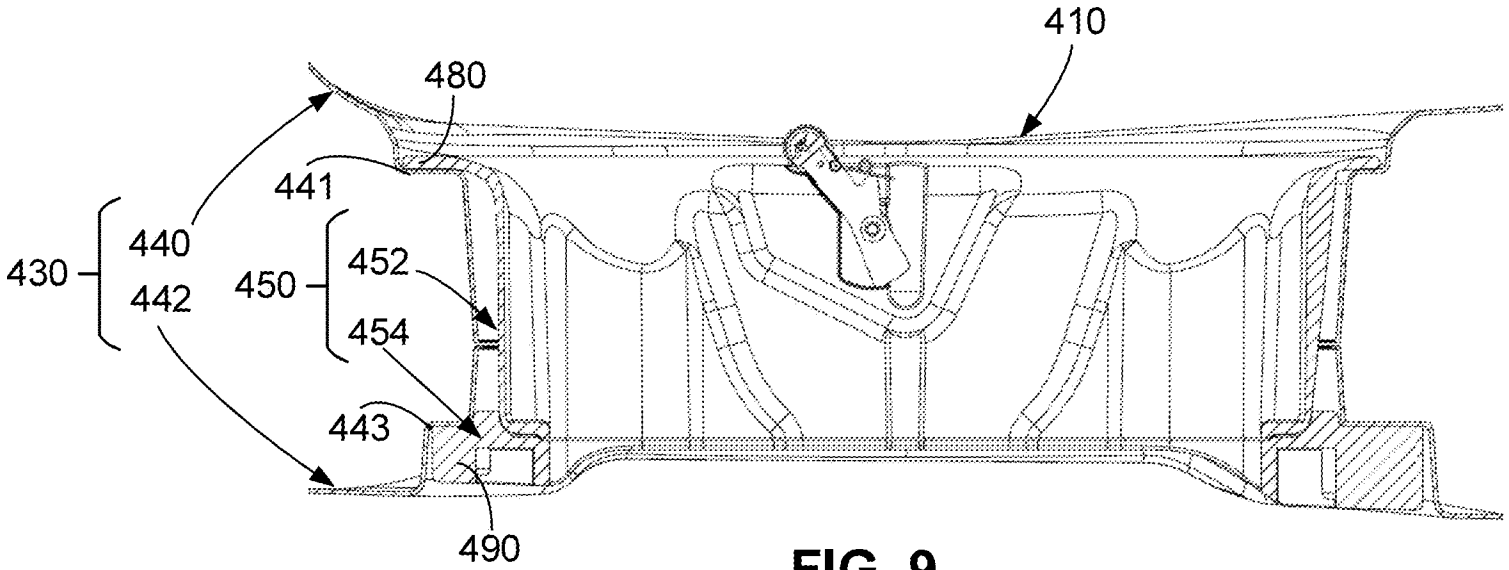
FIG. 9 is a front cross-sectional view of a further example of a portion of a hull and a support assembly.

FIGS. 9, 10A-10B, 11A-11B, and 12 illustrate a further example of a support opening 410, a hull 430, and a support assembly 450 in which the part of the support assembly 450 at least partially defining the support opening 410 includes at least two separate components that are bonded to each other to lock the support assembly 450 to the hull 430. FIG. 9 shows a portion of the hull 430 in a vicinity of the support assembly 450 and in particular, illustrates the support assembly 450 attached to the hull 430. The support opening 410, the hull 430, and the support assembly 450 include features similar to those discussed with respect to the support opening 110, the hull 130, and the support assembly 150. The support opening 410, the hull 430, and the support assembly 450 differ from the support opening 110, the hull 130, and the support assembly 150 in certain respects.

Like the support opening 110, the support opening 410 is defined at least in part by the support assembly 450. In the example shown in FIG. 9, the support assembly 450 includes an upper member 452 and a lower member 454, and the upper member 452 and the lower member 454 at least partially define the support opening 410 when the upper member 452 and the lower member 454 are attached to one another.

As shown in FIG. 9, the hull 430 includes an upper portion 440 and a lower portion 442 similar to the upper portion 140 and the lower portion 142. The upper portion 440 and the lower portion 442 are similarly attached to one another along a periphery of the hull 430 (not shown in FIG. 9).

The support assembly 450 locks the upper portion 440 and the lower portion 442 of the hull 430 together. The upper portion 440 differs from the upper portion 140 in that at least part of the upper portion 440 is positioned below an upper flange 480 of the support assembly 450, and at least part of the lower portion 442 is positioned above a lower flange 490 of the support assembly 450. The upper flange 480 and the lower flange 490 define a locking region 505 (shown in FIG. 10B) where a flange 441 of the upper portion 440 of the hull 430 and a flange 443 of the lower portion 442 of the hull 430 are locked between the upper flange 480 and the lower flange 490. As discussed below, the support assembly 450 includes an upper member 452 and a lower member 454 that are bonded to one another, with the upper member 452 including the upper flange 480 and the lower member 454 including the lower flange 490. When bonded to one another, the upper member 452 and the lower member 454 serve to attach the upper and lower portions 440, 442 of the hull 430 to one another.

Figure 10A:
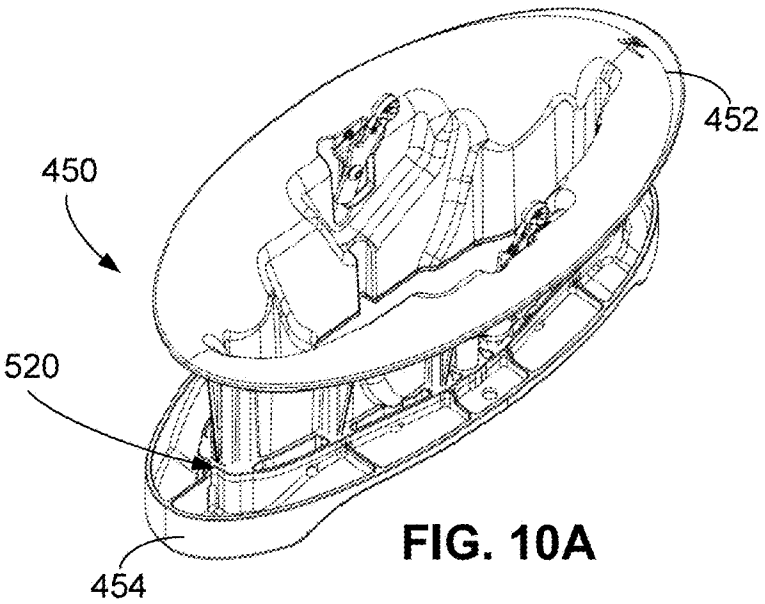
FIGS. 10A-10B are top perspective and side cutaway views, respectively, of the support assembly of FIG. 9.
Figure 10B:
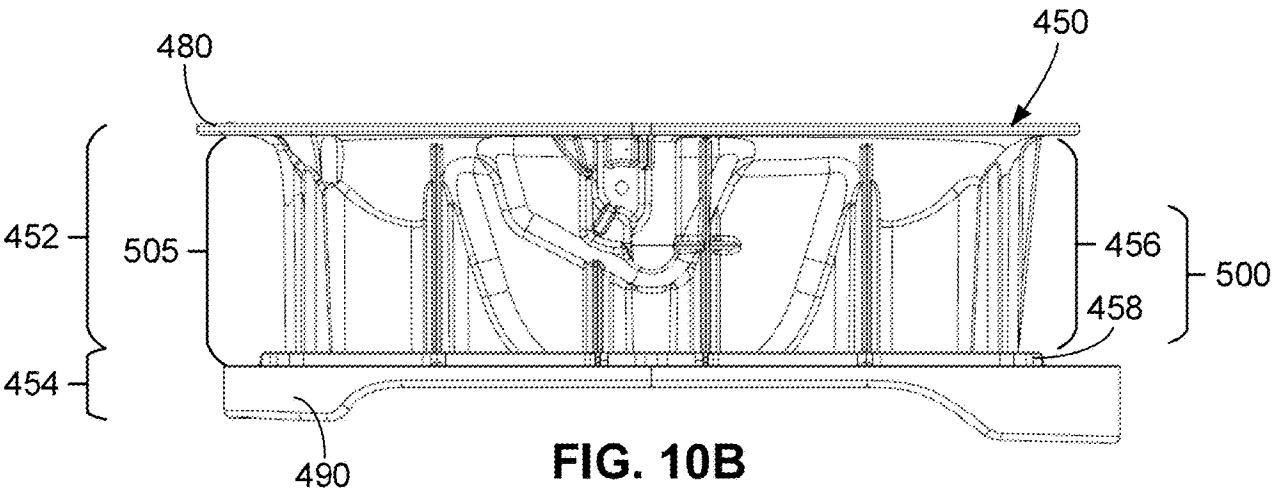

FIGS. 10A-10B show an example of the support assembly 450 is an assembled state in which the upper member 452 is attached to the lower member 454. When assembled, the support assembly 450 has features similar to those discussed with respect to the support assembly 150. The support assembly 450 differs from the support assembly 150 in that the support assembly 450 includes the upper member 452 and the lower member 454. The upper member 452 includes the upper flange 480 and an upper body portion 456, and the lower member 454 includes the lower flange 490 and a lower body portion 458. The upper body portion 456 and the lower body portion 458 form the body 500 of the support assembly when the upper member 452 and the lower member 454 are attached to one another. The body 500, when formed, can have features similar to those discussed with respect to the body 200.

Figure 11A:
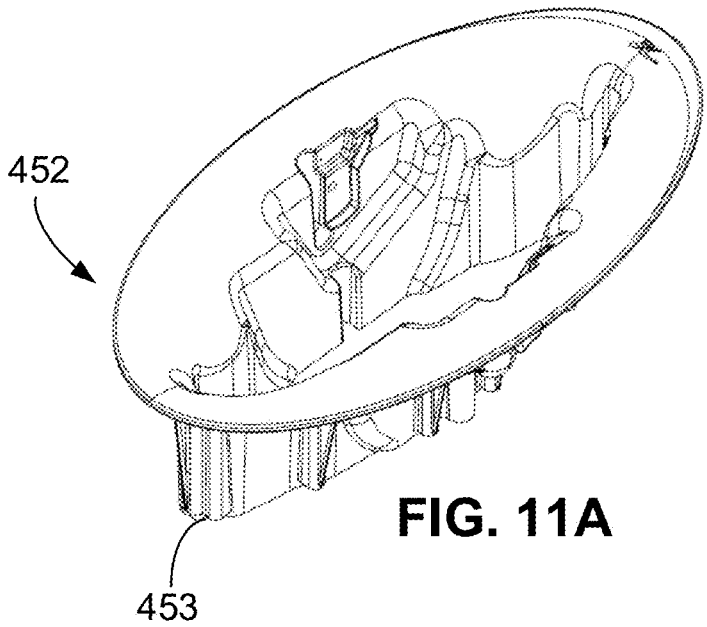
FIGS. 11A-11B are top perspective and bottom views, respectively, of an upper portion of the support assembly of FIGS. 10A-10B.
Figure 11B:
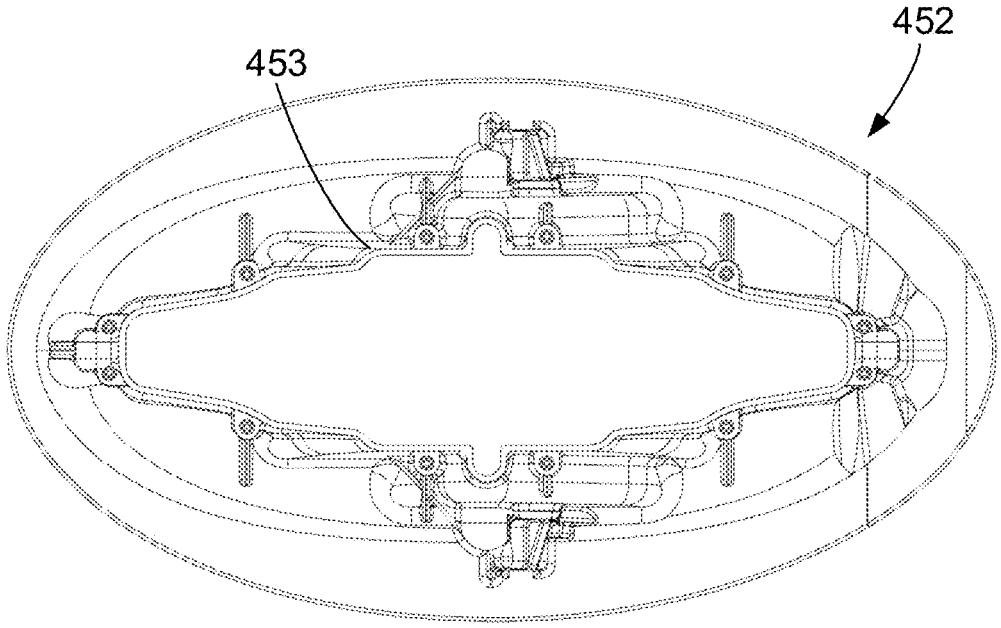
Figure 12:
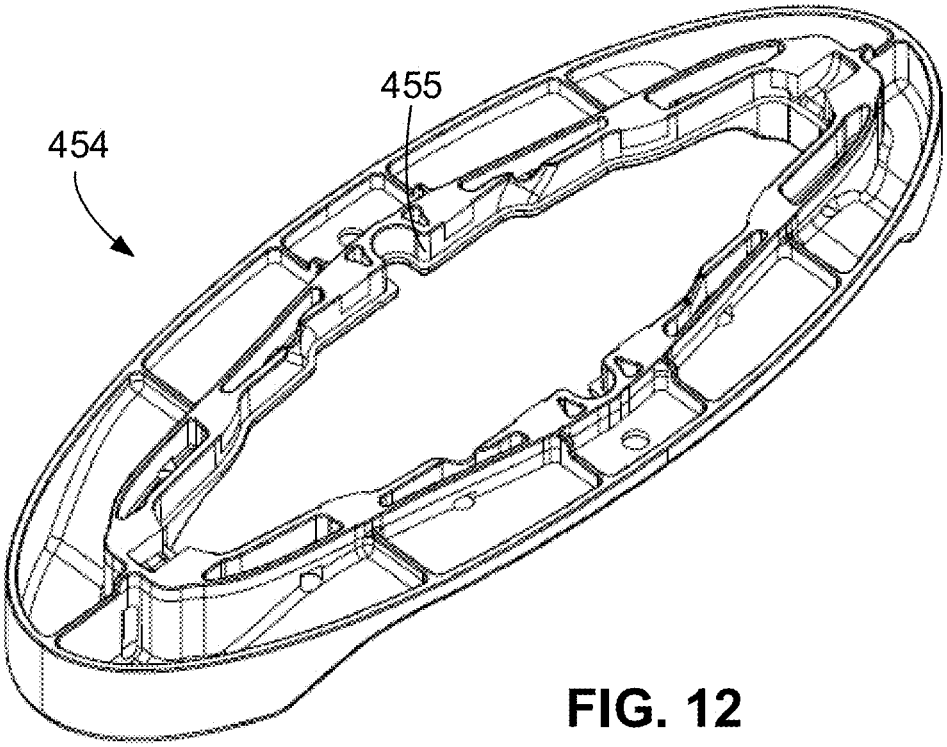
FIG. 12 is a top perspective of a lower portion of the support assembly of FIGS. 10A-10B.

The upper member 452 and the lower member 454 are bonded to one another along an interface 520. Specifically, as shown in FIGS. 11A-11B, the upper member 452 includes a boss 453, and as shown in FIG. 12, the lower member 454 includes a channel 455 to receive the boss 453. As shown in FIGS. 11A-11B and 12, the boss 453 and the channel 455 each forms a continuous loop. An adhesive can be placed between the boss 453 and the channels 455 to bond the upper member 452 and the lower member 454. In some implementations, the boss is on the lower member 454, and the channel 455 is on the upper member 452.

To assemble the hull 430 and the support assembly 450, the upper and lower portions 440, 442 of the hull 430 are welded together at a periphery of the hull 430. Then, the upper and lower members 452, 454 can be inserted into an opening in the hull 430, e.g., similar to the opening 138. The upper member 452 is inserted into the opening in the hull 430 from above, and the lower member 454 is inserted into the opening in the hull 430 from below. Adhesive can be placed between the boss 453 of the upper member 452 and the channel 455 of the lower member 454 before the upper and lower members 452, 454 are inserted into the opening. When the upper and lower members 452, 454 are inserted into the opening, the boss 453 on the upper member 452 mates with the channel 455 on the lower member 454, and the adhesive causes the upper member 452 and the lower member 454 to bond to one another. When bonded to one another, the upper member 452 and the lower member 454 are locked to the hull 430, as the upper and lower flanges 480, 490 engage the flanges 441, 443 of the hull 430 and thus prevent the support assembly 450 from moving relative to the hull 430.

Figure 13A:
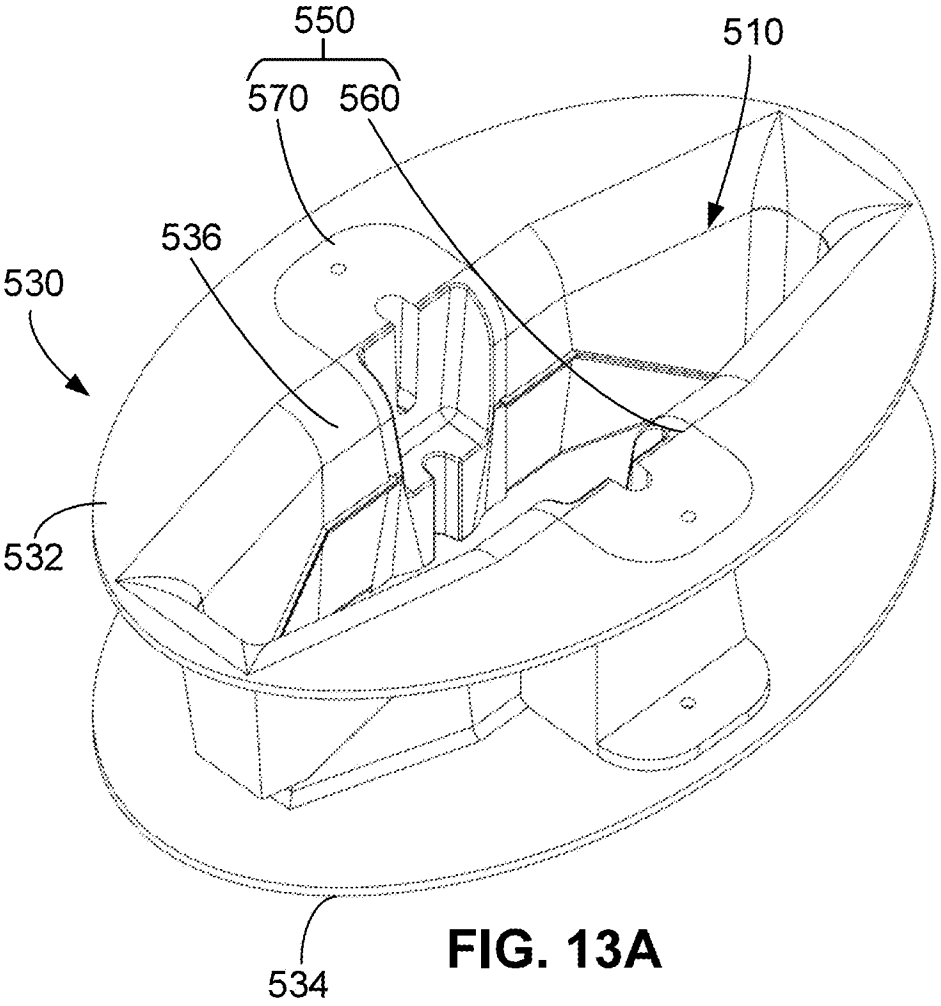
FIGS. 13A-13B are top perspective and top views, respectively, of a further example of a portion of a hull and a support assembly.
Figure 13B:
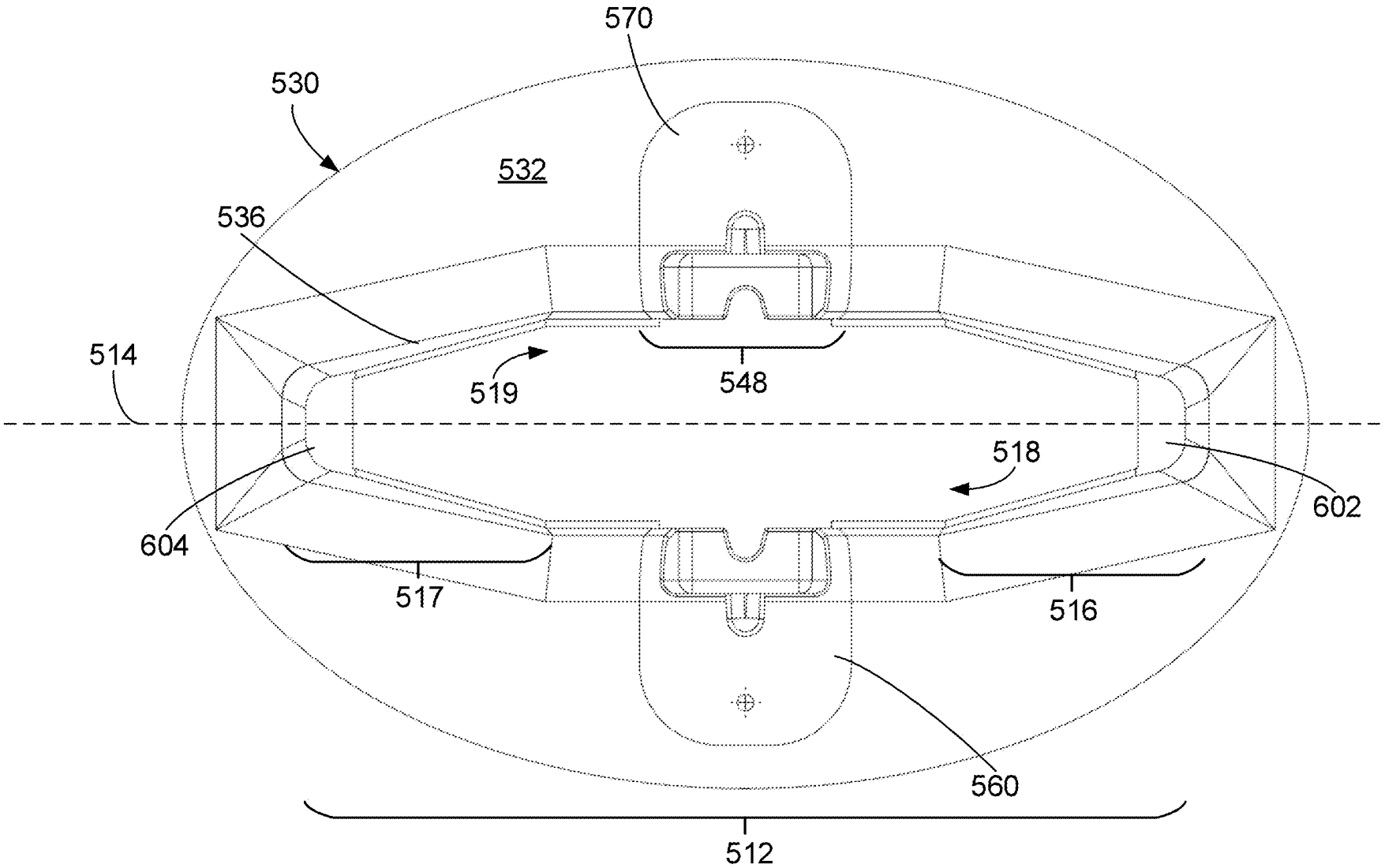

FIGS. 13A-13B, 14, and 15A-15C illustrate a further example of a support opening 510, a hull 530, and a support assembly 550 in which the support assembly 550 includes distinct left and right portions that are separately attached to the hull 530. FIGS. 13A-13B show a portion of the hull 530 in a vicinity of the support assembly 550 and in particular, illustrates the support assembly 550 attached to the hull 530. The support opening 510, the hull 530, and the support assembly 550 include features similar to those discussed with respect to the support opening 110, the hull 130, and the support assembly 150. The support opening 510, the hull 530, and the support assembly 550 differ from the support opening 110, the hull 130, and the support assembly 150 in certain respects.

Like the support opening 110, the support opening 510 is defined at least in part by the support assembly 550. In the example shown in FIGS. 13A-13B, the support assembly 550 does not form a continuous loop that at least partially defines the support opening 510. Rather than being a unitary component forming the upper flange 180, the lower flange 190, and the body 200 as is the case in the example depicted in FIGS. 3A-3D, the support assembly 550 includes two separate support devices that only extend partially about the support opening 510. In particular, the support assembly 550 includes a rightward support device 560 and a leftward support device 570, both of which are attached to the hull 530. The support opening 510 is defined by a combination of the rightward and leftward support devices 560, 570 and an inner surface 536 of the hull 530. The support opening 510 includes a forward portion 516, a rearward portion 517, and lateral portions 518, 519 connecting the forward portion 516 and the rearward portion 517.

Figure 14:
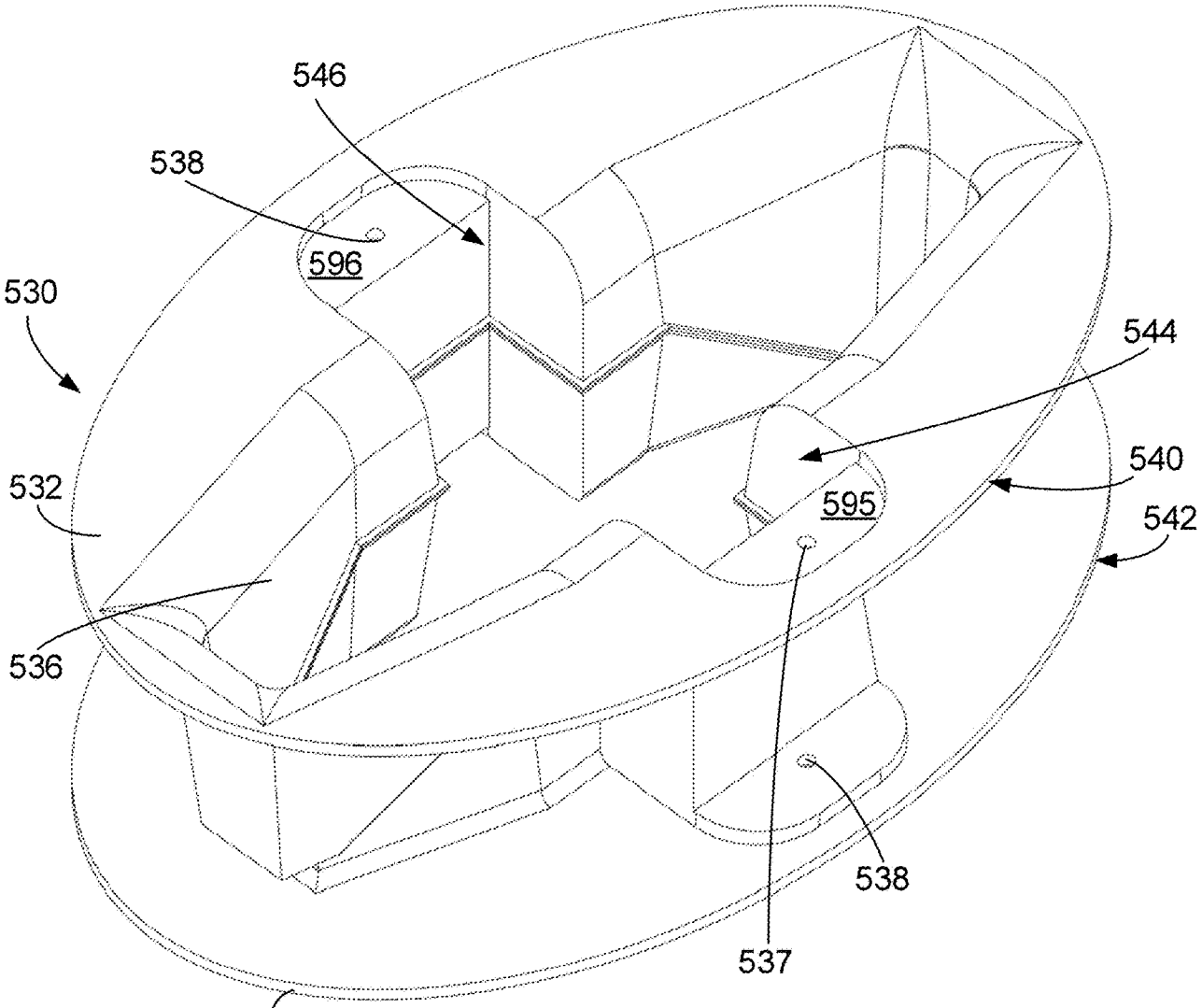
FIG. 14 is a top perspective view of the portion of the hull shown in FIGS. 13A-13B.

As shown in FIG. 14, the hull 530 includes an upper portion 540 and a lower portion 542 similar to the upper portion 140 and the lower portion 142. The upper portion 540 and the lower portion 542 are similarly attached to one another along a periphery of the hull 530 (not shown in FIG. 9). The upper portion 540 and the lower portion 542 define a rightward slot 544 to receive the rightward support device 560, and a leftward slot 546 to receive the leftward support device 570. The rightward and leftward slots 544, 546 are symmetric about the fore-aft axis 514. The rightward slot 544 and the leftward slot 546 both extend from an upper surface 532 of the hull 530 to a lower surface 534 of the hull 530. The rightward slot 544 and the leftward slot 546 are both recessed relative to the upper surface 532 of the hull 530. Furthermore, the rightward slot 544 and the leftward slot 546 are recessed relative to the inner surface 536 of the hull 530. Referring back to FIG. 13B, the rightward slot 544 and the leftward slot 546 each have a dimension 548 that is less than a dimension 512 of the support opening 510 (e.g., a length of the support opening 510) extending along the fore-aft axis 514 of the support opening 510. In implementations, the dimension 548 is between 10% and 90% of the dimension 512 of the support opening 510, e.g., less than 90%, less than 80%, less than 70%, less than 60%, less than 50%, less than 40%, less than 30%, between 10% and 70%, between 10% and 50%, between 10% and 30%, etc. of the dimension 512 of the support opening 510.

Referring to FIG. 14, the hull 530 includes holes 537, 538 in the rightward slot 544. The holes 537, 538 are configured to receive fasteners, e.g., threaded fasteners, to fasten the hull 530 to the support assembly 550, e.g., to fasten the upper portion 540 of the hull 530 to the rightward support device 560 via the hole 537 and to fasten the lower portion 542 of the hull 530 to the rightward support device 560 via the hole 538. The hull 530 includes corresponding holes for the leftward slot 546. The hull 530 further includes an upwardly-directed surface 595 and an upwardly-directed surface 596 below the upper surface 532. The upwardly-directed surface 595 and the upwardly-directed surface 596 abut upper portions of the rightward and leftward support devices 560, 570.

The rightward and leftward support devices 560, 570 are configured to mount the shaft of the propulsion mechanism to the hull 530 and to support lateral portions of the housing of the propulsion mechanism. The rightward and leftward support devices 560, 570 are symmetric to one another about the fore-aft axis 514 of the support opening 510. Features described with respect to the rightward support device 560 are thus applicable to the leftward support device 570. As shown in FIGS. 13A-13B, the rightward support device 560 and the leftward support device 570 are positioned between the forward portion 516 and the rearward portion 517 of the support opening 510 and at least partially define the lateral portions 518, 519 of the support opening 510. A top surface of each of the rightward support device 560 and the leftward support device 570 is flush with the upper surface 532 of the hull 530.

Figure 15B:
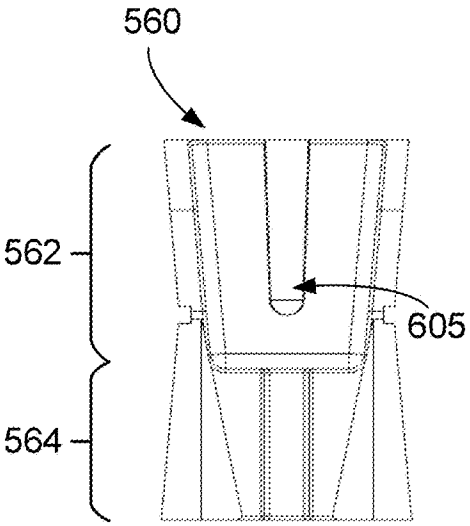
FIGS. 15A-15C are perspective, side, and rear views of a rightward support device of the support assembly of FIGS. 13A-13B.
Figure 15A:
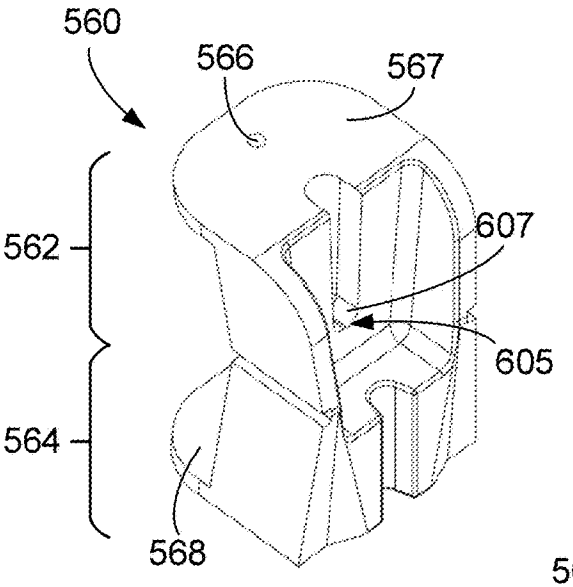
Figure 15C:
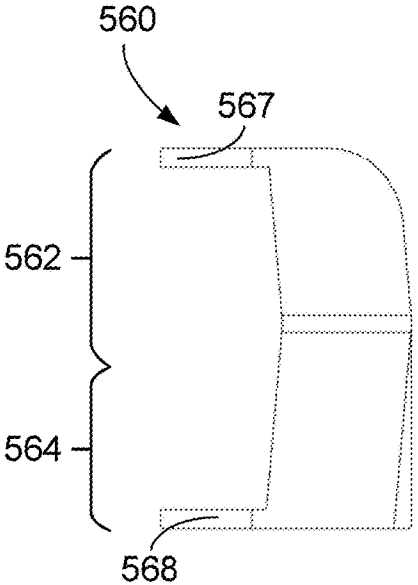

As shown in FIG. 15A, the rightward support device 560 includes an upper portion 562 and a lower portion 564. The upper portion 562 includes a slot 605 similar to the slots 205, 206 described with respect to FIGS. 4A-4B. The slot 605 is at least partially defined by a rounded bearing surface 607 to receive the shaft of the propulsion mechanism (e.g., the shaft 122). The slot 605 can receive a locking mechanism similar to the locking mechanism 170.

The rightward support device 560 further includes holes (e.g., a hole 566 on an upper flange 567 on the upper portion 562) that are aligned with the holes 537, 538 when the rightward support device 560 is received in the rightward slot 544 of the hull 530. To fasten the rightward support device 560, a fastener is inserted into the hole 566 and the hole 537, and another fastener is inserted into a hole on a lower flange 568 on the lower portion 564 (not shown) and the hole 538. The abutment between surfaces of the hull 530 and the rightward support device 560 in combination with the fasteners prevent relative movement of the rightward support device 560.

In the implementations described with respect to FIGS. 3A-3D, the body 200 of the support assembly 150 was described as including upwardly-directed surfaces to support the propulsion mechanism 120 when the propulsion mechanism is received in the support opening 110. Referring to FIG. 13B, the hull 530 includes upwardly-directed surfaces to support the propulsion mechanism. In particular, the hull 530 includes an upwardly-directed surface 602 adjacent to the forward portion 516 of the support opening 510 and an upwardly-directed surface 604 adjacent to the rearward portion 517 of the support opening 510. The upwardly-directed surfaces 602, 604 serve a function similar to that described with respect to the upwardly-directed surfaces 202, 204, except that the upwardly-directed surfaces 602, 604 are part of the hull 530 rather than the support assembly 550.

To assemble the hull 530 and the support assembly 550 and thereby provide the support opening 510, the hull 530 can be formed using the molding processes described in this disclosure. The support assembly 550 can then be attached to the hull 530 using fasteners through the holes on the right and left support devices 560, 570 and through the corresponding holes on the hull 530. In alternative implementations, rather than using fasteners, the support assembly 550 can be bonded to the hull 530 using adhesives or chemical welding processes.

Figure 16:
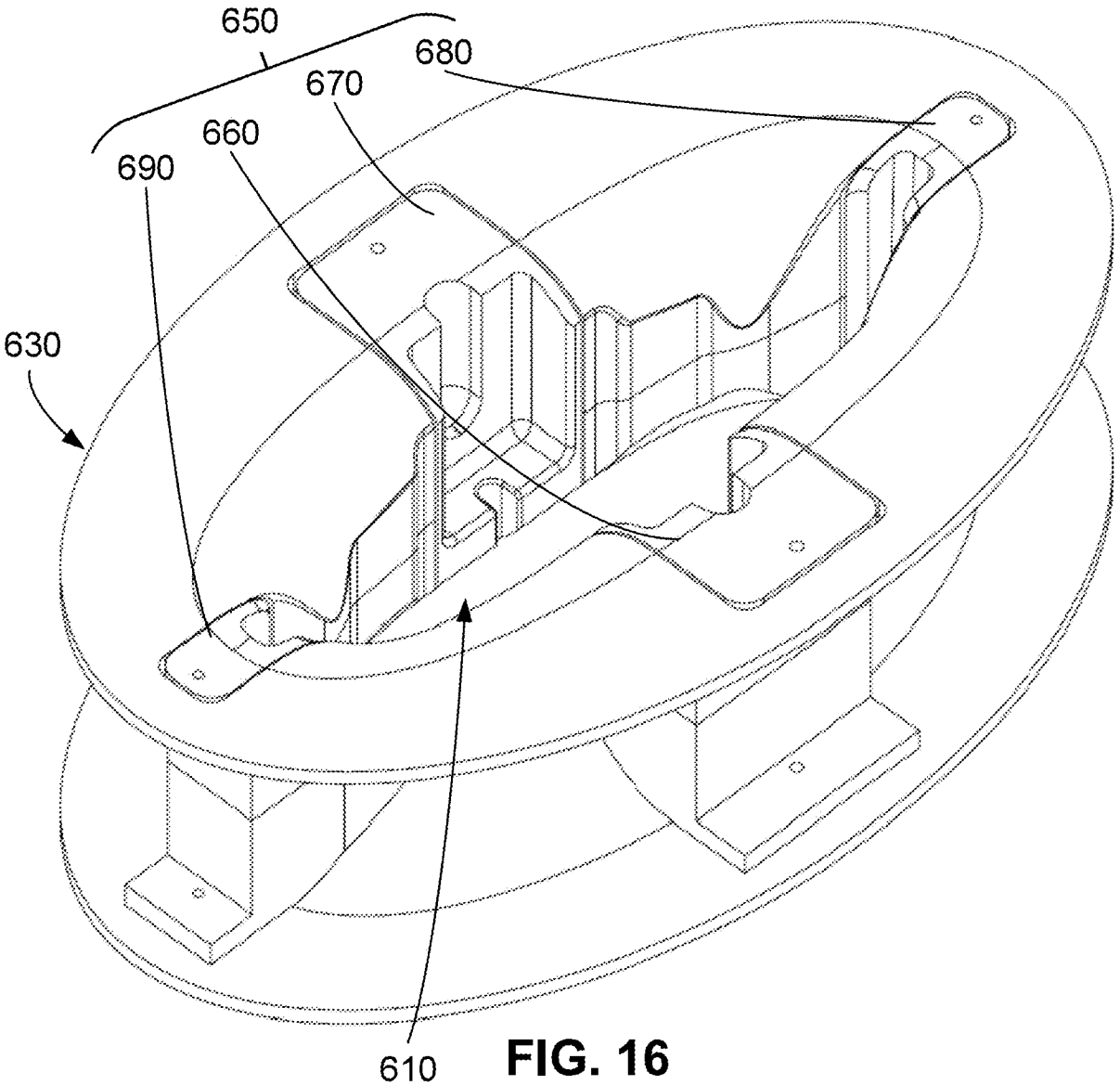
FIG. 16 is a top perspective view of a further example of a portion of a hull and a support assembly.
Figure 17:
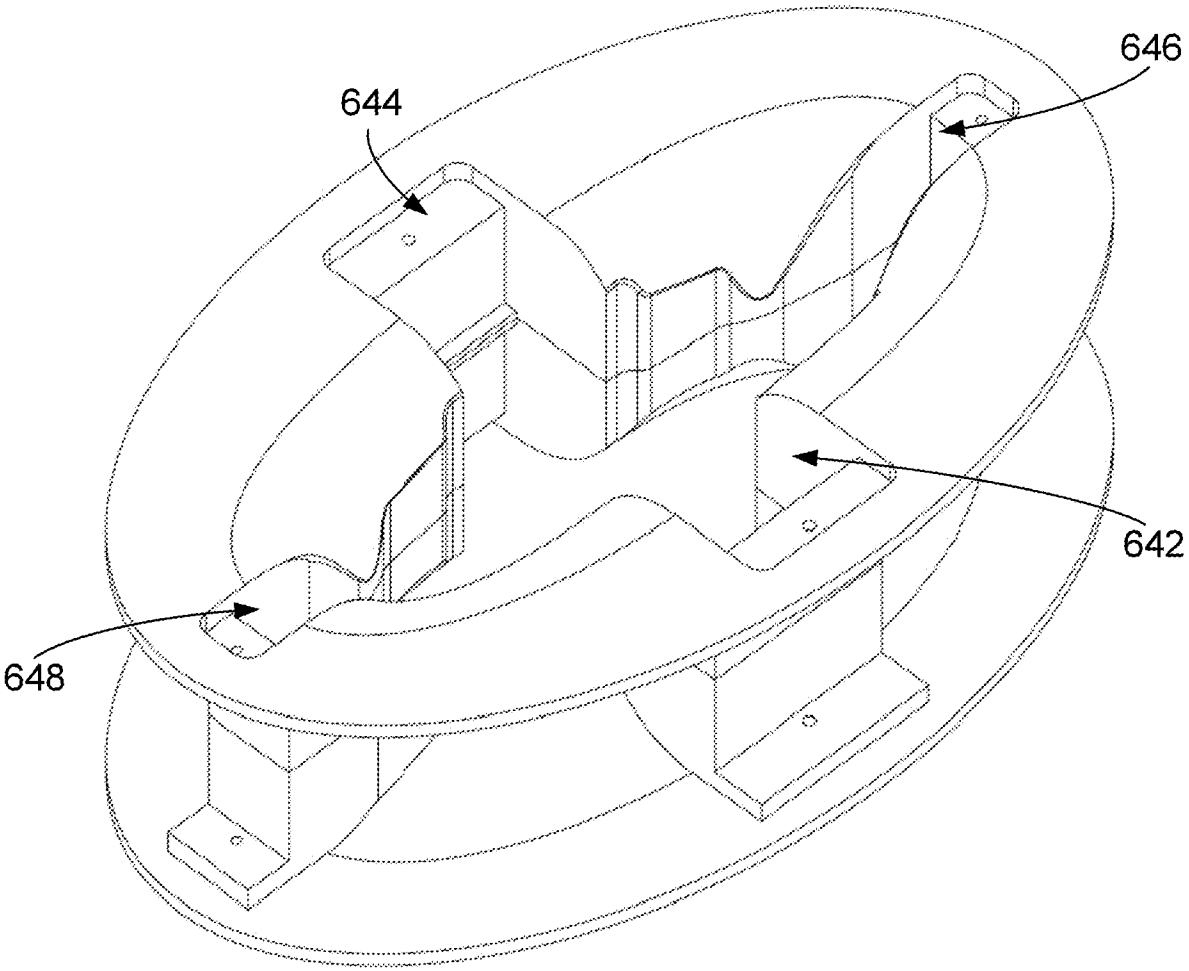
FIG. 17 is a top perspective view of the portion of the hull shown in FIG. 16.

FIGS. 16, 17, and 18A-18B illustrate a further example of a support opening 610, a hull 630, and a support assembly 650 in which the support assembly 650 further includes forward and rearward portions that are separately attached to the hull 630. FIGS. 16-17 show a portion of the hull 630 in a vicinity of the support assembly 650 and in particular, illustrates the support assembly 650 attached to the hull 630. The support opening 610, the hull 630, and the support assembly 650 include features similar to those discussed with respect to the support opening 510, the hull 530, and the support assembly 550, with the exception of a few distinctions.

As shown in FIG. 16, the support opening 610 is at least partially defined by the hull 630 and the support assembly 650. The support assembly 650 includes a rightward support device 660 similar to the rightward support device 560 and a leftward support device 670 similar to the leftward support device 570. The support assembly 650 further includes a forward support device 680 and a rearward support device 690. In this regard, each of the rightward support device 660, the leftward support device 670, the forward support device 680, and the rearward support device 690 at least partially define the support opening 610. Each of the rightward, leftward, forward, and rearward support devices 660, 670, 680, 690 is attached to the hull 630, e.g., via fasteners through holes similar to the mechanism for fastening the rightward and leftward support devices 560, 570 to the hull 530 or via another appropriate mechanism. The rightward, leftward, forward, and rearward support devices 660, 670, 680, 690 at least partially define rightward, leftward, forward, and rearward portions, respectively, of the support opening 610.

As shown in FIG. 17, the hull 630 includes corresponding slots 642, 644, 646, and 648 to receive the rightward, leftward, forward, and rearward support devices 660, 670, 680, 690. The slots 642, 644, 646, 648 are the slots 544, 546 in that the slots 642, 644, 646, 648 are recessed relative to the upper surface of the hull 630 and the recessed relative to the inner surface of the hull 630 that at least partially defines the support opening 610.

Figure 18B:
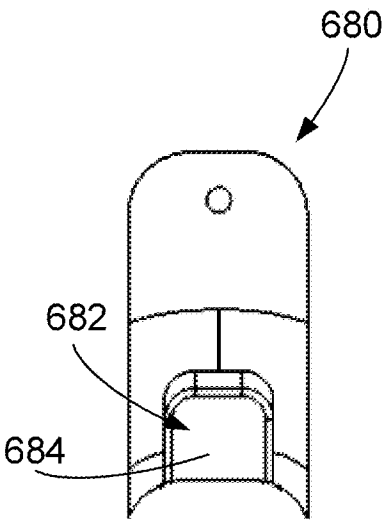
FIGS. 18A-18B are perspective and top views of a forward support device of the support assembly of FIG. 16.
Figure 18A:
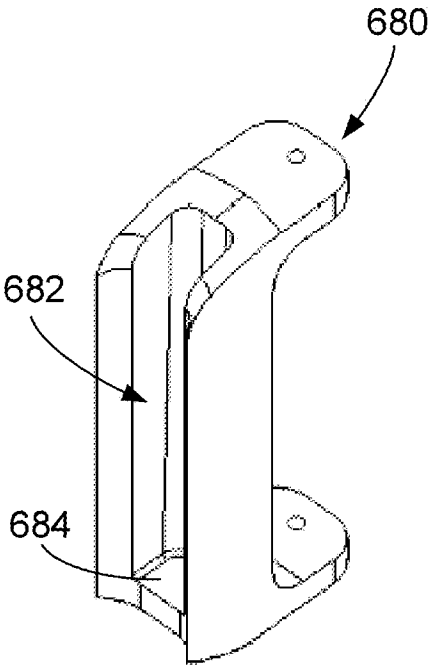

The forward support device 680 and the rearward support device 690 are symmetric to one another, e.g., relative to the left-right axis of the support opening 610. FIGS. 18A-18B illustrate an example of the forward support device 680. The rearward support device 690 includes features similar to those discussed with respect to the forward support device 680.

Whereas in the implementations described with respect to FIGS. 13, 14A-14B, and 15A-15C, the upwardly-directed surfaces 602, 604 are surfaces of the hull 530, in the implementations described with respect to FIGS. 15, 16, and 17A-17B, the forward support device 680 and the rearward support device 690 include upwardly-directed surfaces for supporting the housing of the propulsion mechanism. For example, as shown in FIGS. 17A-17B, the forward support device 680 includes a slot 682 and an upwardly-directed surface 684 at least partially defining the slot 682. The upwardly-directed surface 684 abuts and supports the forward portion of the housing of the propulsion mechanism when the propulsion mechanism is mounted to the watercraft. The rearward support device 690 can include a similar slot and upwardly-directly surface that abuts and supports the rearward portion of the housing of the propulsion mechanism.

Figure 19A:
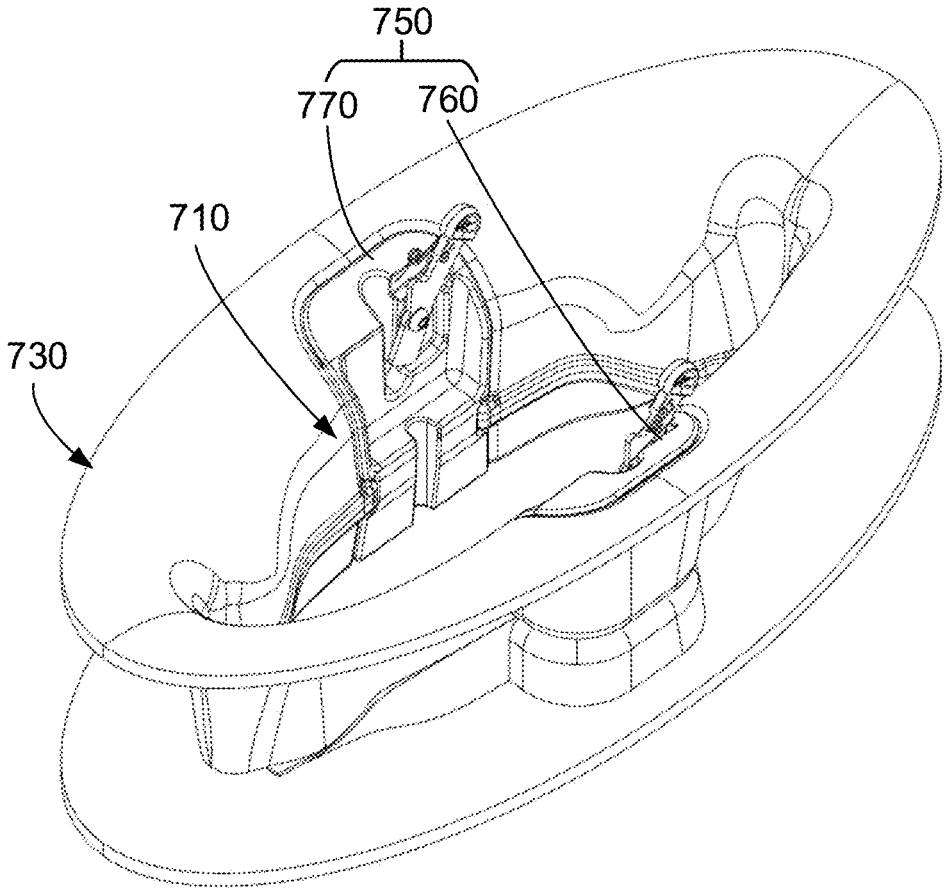
FIGS. 19A-19B are top perspective and side cross-sectional views of a further example of a portion of a hull and a support assembly.
Figure 19B:
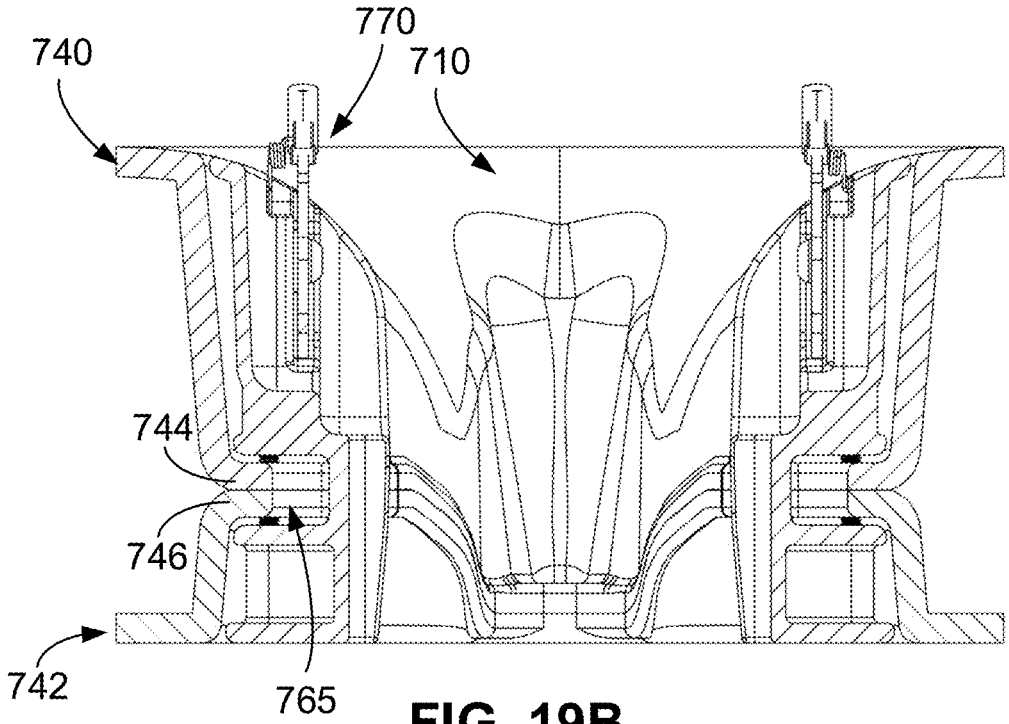
Figure 20:
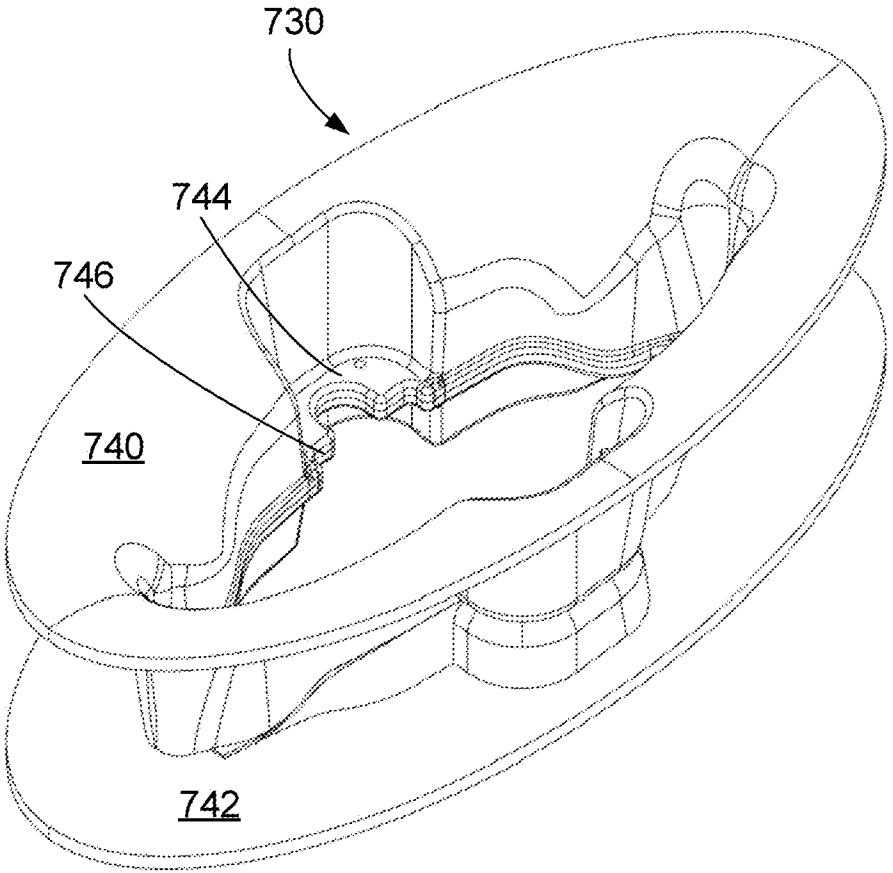
FIG. 20 is a top perspective view of the portion of the hull shown in FIGS. 19A-19B.

FIGS. 19A-19B, 20, and 21A-21C illustrate a further example of a support opening 710, a hull 730, and a support assembly 750 in which the support assembly 750 is attached to the hull 730 at a central portion of the support assembly 750, rather than at an upper portion or lower portion of the support assembly 750. FIGS. 19A-19B and 20 show a portion of the hull 730 in a vicinity of the support assembly 750 and in particular, illustrates the support assembly 750 attached to the hull 730. The support opening 710, the hull 730, and the support assembly 750 include features similar to those discussed with respect to the support opening 510, the hull 530, and the support assembly 550, with the exception of a few distinctions.

As shown in FIGS. 19A-19B, the support opening 710 is at least partially defined by the hull 730 and the support assembly 750. The support assembly 750 includes a rightward support device 760 similar to the rightward support device 560 and a leftward support device 770 similar to the leftward support device 570. The rightward support device 760 and the leftward support device 770 differ from the rightward support device 560 and the leftward support device 570 in that the rightward support device 760 and the leftward support device 770 are fastened to a portion of the hull 730 positioned between an upper portion of the support device and a lower portion of the support device.

The rightward support device 760 and the leftward support device 770 at least partially define the support opening 710 and can receive a locking mechanism (similar to the locking mechanism 170) for mounting the shaft of the propulsion mechanism to the watercraft. The rightward and leftward support devices 760, 770 are symmetric about the left-right axis of the support opening. In this regard, features of the leftward support device 770 are similar to the features of the rightward support device 760 described in this disclosure.

Figure 21B:
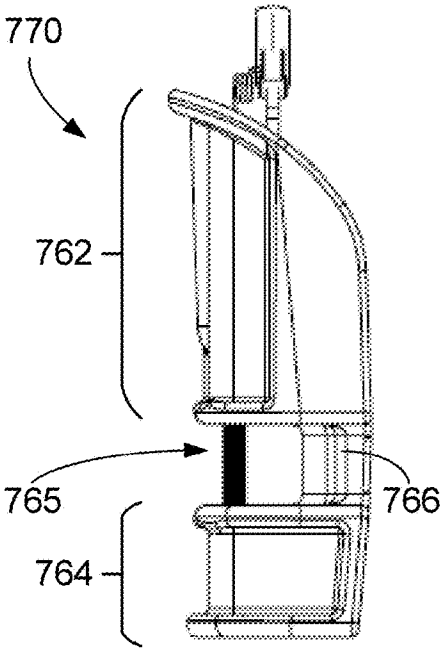
FIGS. 21A-21C are perspective, side, and bottom views of a leftward support device of the support assembly of FIGS. 19A-19B.
Figure 21A:
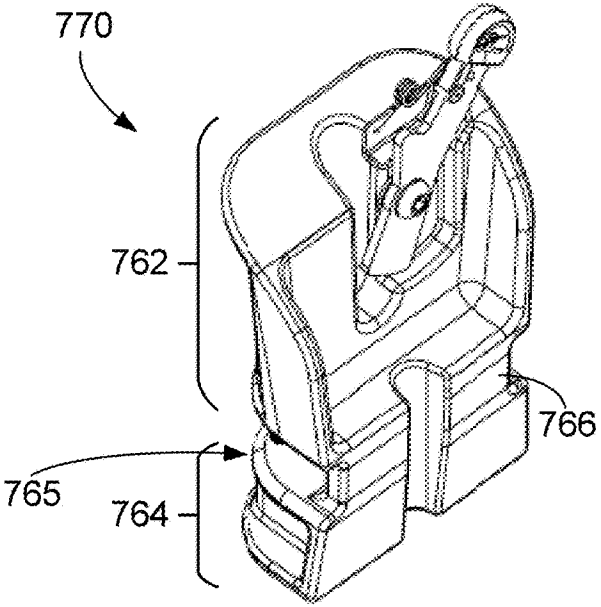

For example, as shown in FIGS. 19B and 21A-21B, the leftward support device 770 includes an upper portion 762 and a lower portion 764 (shown in FIG. 21B), and at least a portion of an upper portion 740 and a lower portion 742 of the hull 730 (shown in FIG. 19B) are positioned between the upper portion 762 and the lower portion 764 of the leftward support device 770. In particular, referring to FIGS. 19B and 20, a flange 744 on the upper portion 740 of the hull 730 and a flange 746 on the lower portion 742 of the hull 730 extend into a gap 765 between the upper portion 762 and the lower portion 764 of the leftward support device 770.

Figure 21C:
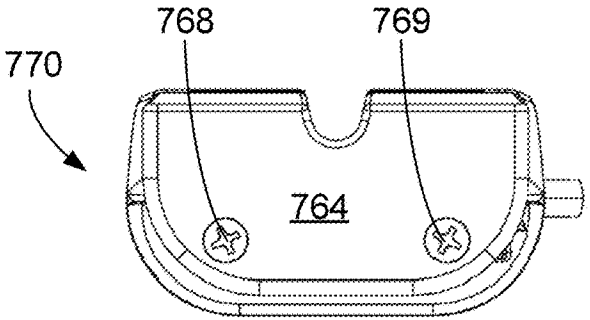

FIGS. 21A-21C illustrate an example of the leftward support device 770. The leftward support device 770 includes a connection member 766 that connects the upper portion 762 and the lower portion 764 of the leftward support device 770. The connection member 766, the lower portion 764, and the upper portion 762 are integral with one another. For example, these elements can be formed as a single component in a molding process. To fasten the leftward support device 770 to the hull 730, fasteners 768, 769 can be inserted through the lower portion 764 of the leftward support device 770, through the flanges 744, 746 on the hull 730, and through the upper portion 762 of the leftward support device 770. Thus the leftward support device 770 is fastened to the hull 730 in the vicinity of the gap 765.

Figure 22A:
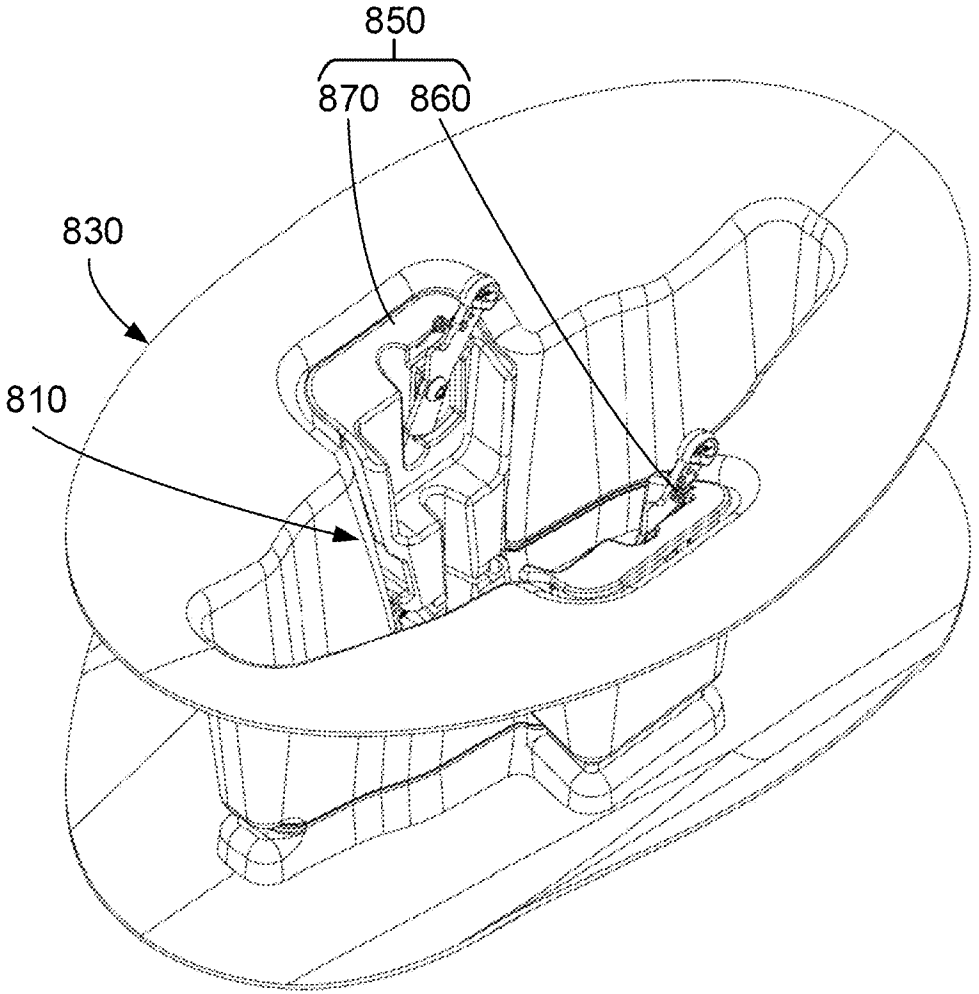
FIGS. 22A-22B are top perspective and side cross-sectional views of a further example of a portion of a hull and a support assembly.
Figure 22B:
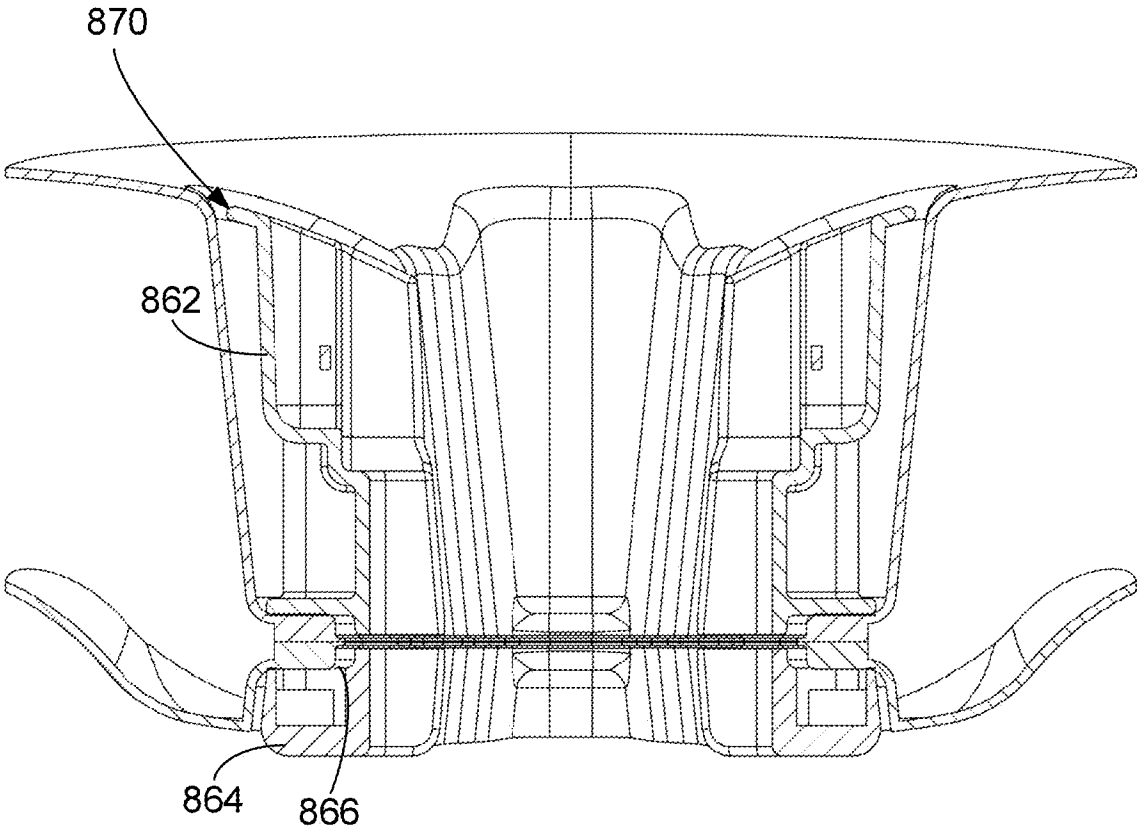
Figure 23:
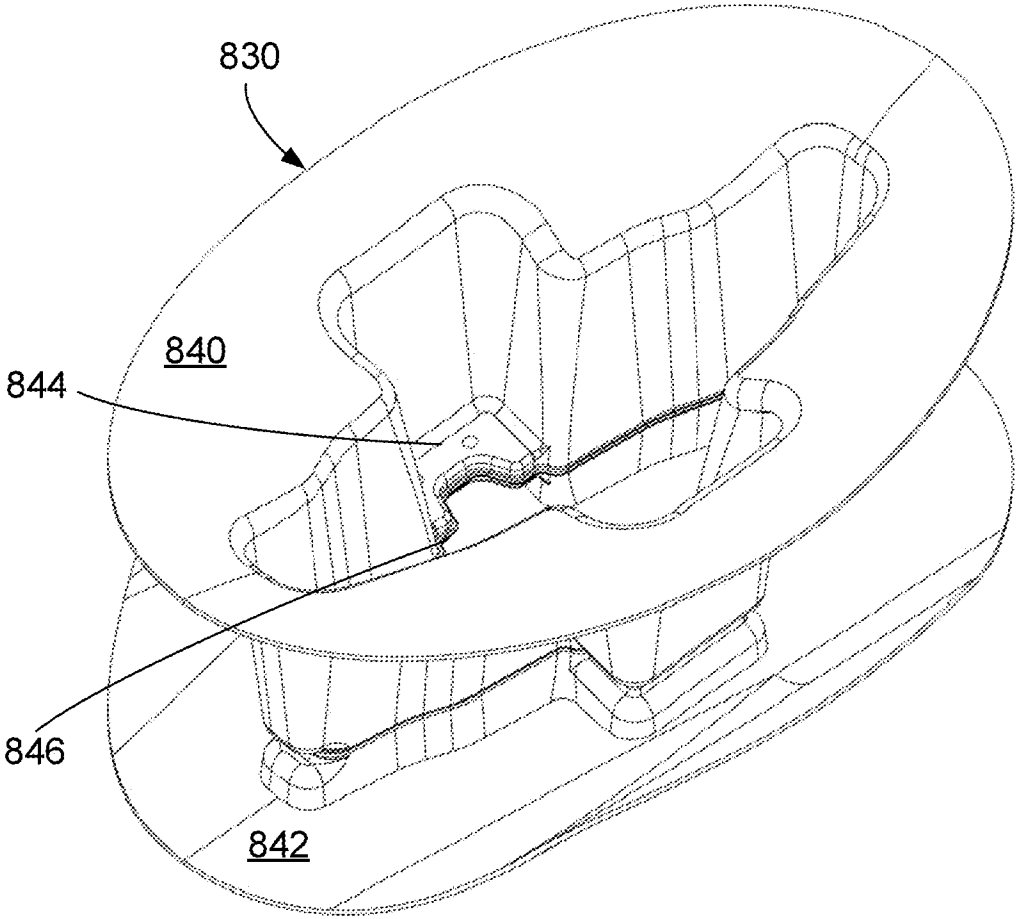
FIG. 23 is a perspective view of the portion of the hull shown in FIGS. 22A-22B.

FIGS. 22A-22B, 23, and 24 illustrate a further example of a support opening 810, a hull 830, and a support assembly 850 in which support devices of the support assembly 850 are formed of two separate components attachable to one another and to the hull 830. FIGS. 22A-22B and 23 show a portion of the hull 830 in a vicinity of the support assembly 850 and in particular, illustrates the support assembly 850 attached to the hull 830. The support opening 810, the hull 830, and the support assembly 850 include features similar to those discussed with respect to the support opening 710, the hull 730, and the support assembly 750, with the exception of a few distinctions. In particular, in the example depicted in FIGS. 22A-22B, 23, and 24, rightward and leftward support devices 860, 870 are each formed of an upper member and a lower member that are distinct from one another.

Similar to the rightward support device 760 and the leftward support device 770, the rightward support device 860 and the leftward support device 870 at least partially define the support opening 810 and can receive a locking mechanism (similar to the locking mechanism 170) for mounting the shaft of the propulsion mechanism to the watercraft. The rightward and leftward support devices 860, 870 are symmetric about the left-right axis of the support opening. In this regard, features of the leftward support device 870 are similar to the features of the rightward support device 860 described in this disclosure.

Figure 24:
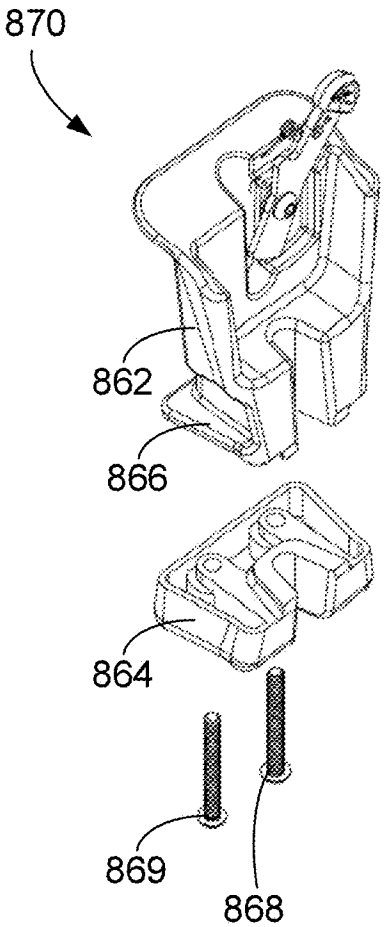
FIG. 24 is a perspective, exploded view of a leftward support device of the support assembly of FIGS. 22A-22B.

As shown in FIGS. 22B and 24, the leftward support device 870 includes an upper portion 862 and a lower portion 864 (shown in FIG. 21B), and at least a portion of an upper portion 840 and a bottom portion 842 of the hull 830 (shown in FIG. 19B) are positioned between the upper portion 862 and the lower portion 864 of the leftward support device 870. In particular, referring to FIGS. 22B and 23, a flange 844 on the upper portion 840 of the hull 830 and a flange 846 on the lower portion 842 of the hull 830 extend into a gap 866 between the upper portion 862 and the lower portion 864 of the leftward support device 870.

FIG. 24 illustrates an example of the leftward support device 870. Unlike the example shown in FIGS. 19A-19B, 20, and 21A-21C, which includes the connection member 766 between the upper and lower portions 762, 764, in the implementations represented in FIGS. 22A-22B, 23, and 24, the upper portion 862 and the lower portion 864 are distinct members that are separated from one another by the gap 866. The upper portion 862 and the lower portion 864 can be separate components formed in different molding processes. To fasten the leftward support device 870 to the hull 830, fasteners 868, 869 can be inserted through the lower portion 864 of the leftward support device 870, through the flanges 844, 846 on the hull 830, and through the upper portion 862 of the leftward support device 870. Thus the leftward support device 870 is fastened to the hull 830 in the vicinity of the gap 866.

Figure 25:
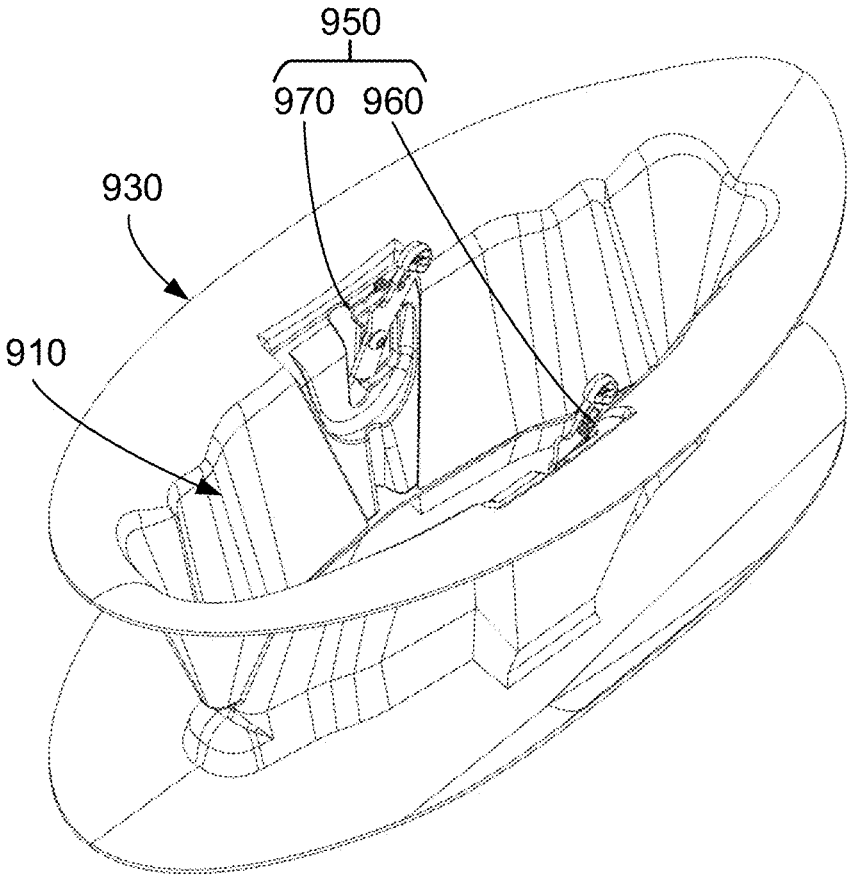
FIG. 25 is a top perspective of a further example of a portion of a hull and a support assembly.
Figure 26:
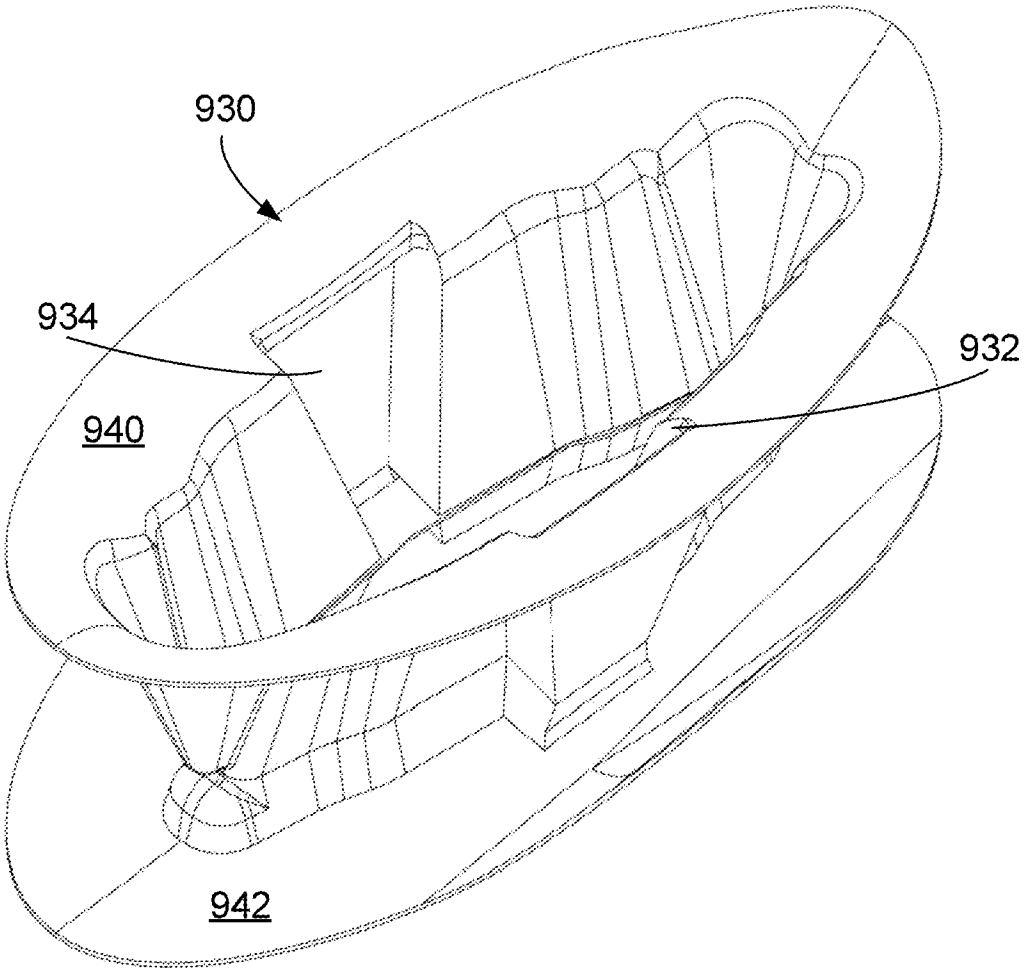
FIG. 26 is a perspective view of the portion of the hull shown in FIG. 25.

FIGS. 25, 26, and 27A-27C illustrate a further example of a support opening 910, a hull 930, and a support assembly 950 in which the support assembly 950 includes separate support devices that are insert-molded to the hull 930. FIGS. 25-26 show a portion of the hull 930 in a vicinity of the support assembly 950 and in particular, illustrates the support assembly 950 attached to the hull 930. The support opening 910, the hull 930, and the support assembly 950 include features similar to those discussed with respect to the support opening 710, the hull 730, and the support assembly 750, with the exception of a few distinctions. In particular, in this example, the support assembly 950 is insert molded to the hull 930. As shown in FIG. 25, the support assembly 950 includes a rightward support device 960 and a leftward support device 970. Similar to the rightward support device 760 and the leftward support device 770, the rightward support device 960 and the leftward support device 970 at least partially define the support opening 910 and can receive a locking mechanism (similar to the locking mechanism 170) for mounting the shaft of the propulsion mechanism to the watercraft. The rightward and leftward support devices 960, 970 are symmetric about the left-right axis of the support opening. In this regard, features of the leftward support device 970 are similar to the features of the rightward support device 960 described in this disclosure.

Figure 27B:
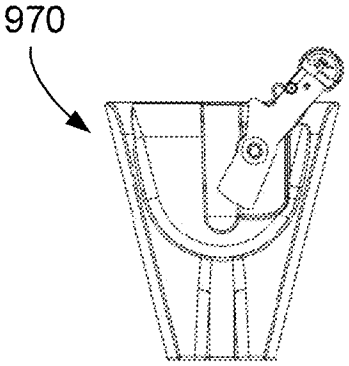
FIGS. 27A-27C are perspective, side, and bottom views of a leftward support device of the support assembly of FIG. 25.
Figure 27C:
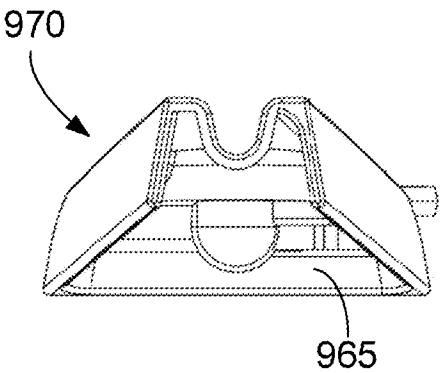
Figure 27A:
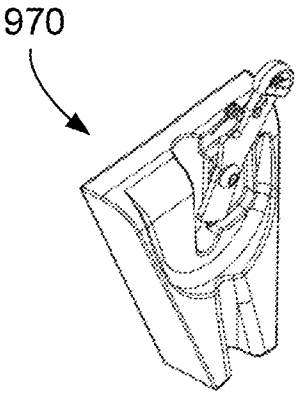

As shown in FIG. 26, the hull 930 includes a rightward slot 932 and a leftward slot 934, each of which is tapered downwardly along an upper portion 940 of the hull 930. The slots 932, 934 can terminate at a lower portion 942 of the hull 930. The rightward slot 932 receives the rightward support device 960, and the leftward slot 934 receives the leftward support device 970. To promote bonding between the slots 932, 934 and the support devices 960, 970, when the support devices 960, 970 are insert molded to the hull 930, the hull 930 can form around an interior portion of the support device 960, 970. For example, as shown in FIG. 27A-27C, the leftward support device 970 can include an inner surface 965 to which the hull 930 is bonded during the insert-molding process.

Figure 28:
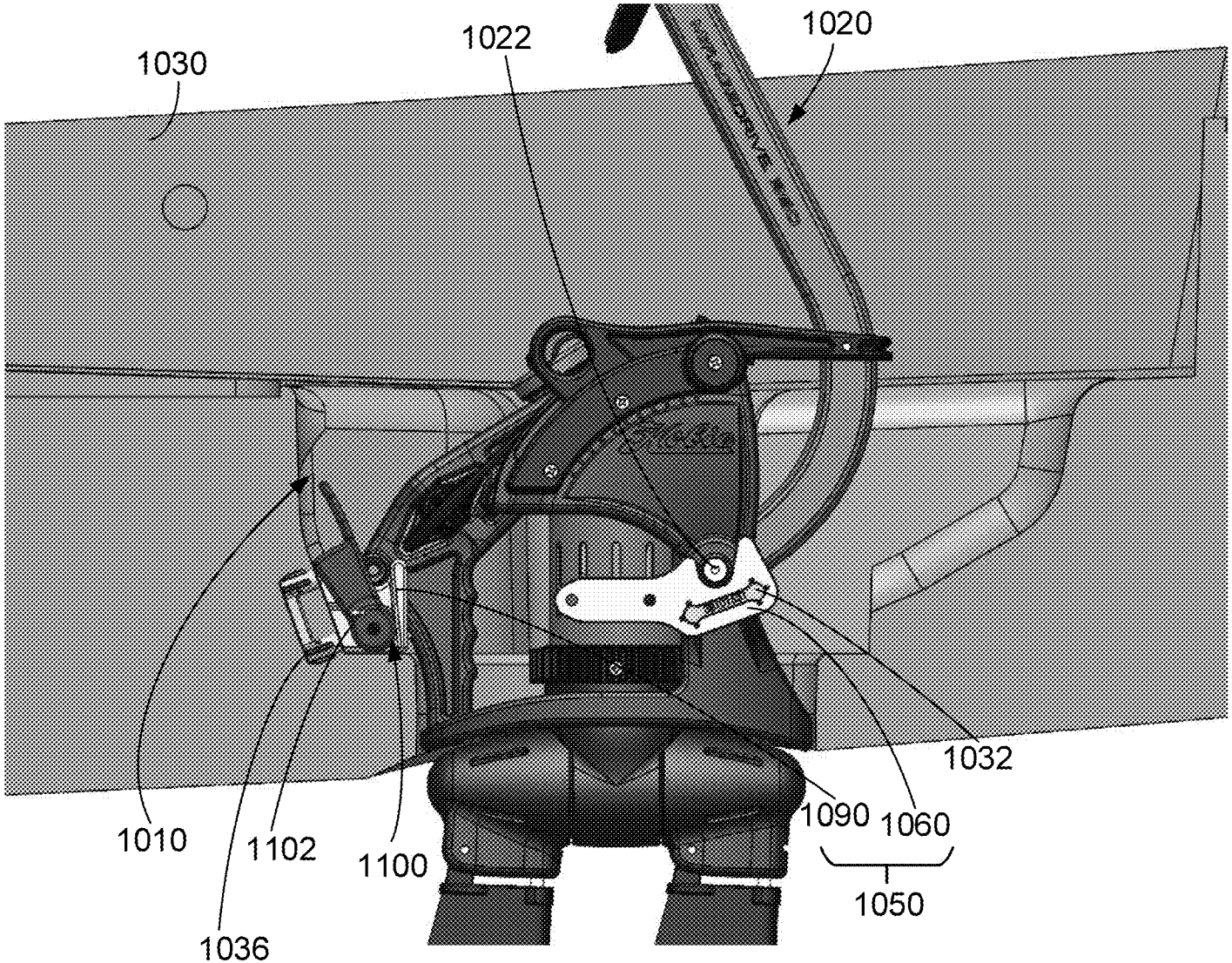
FIGS. 28-29 are side cutaway and top views of a further example of a portion of a hull and a support assembly, with a propulsion mechanism shown.
Figure 29:
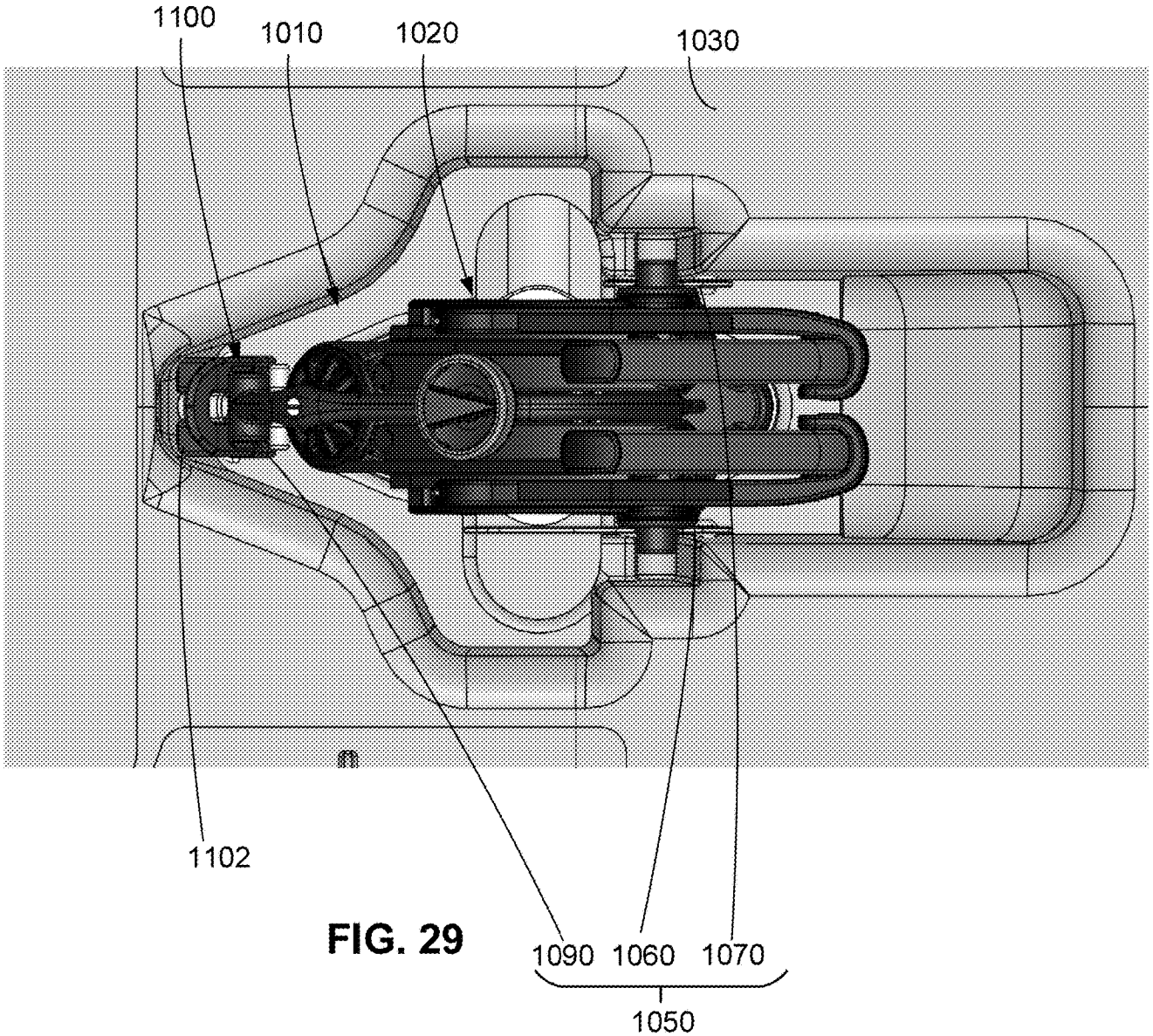
Figure 30:
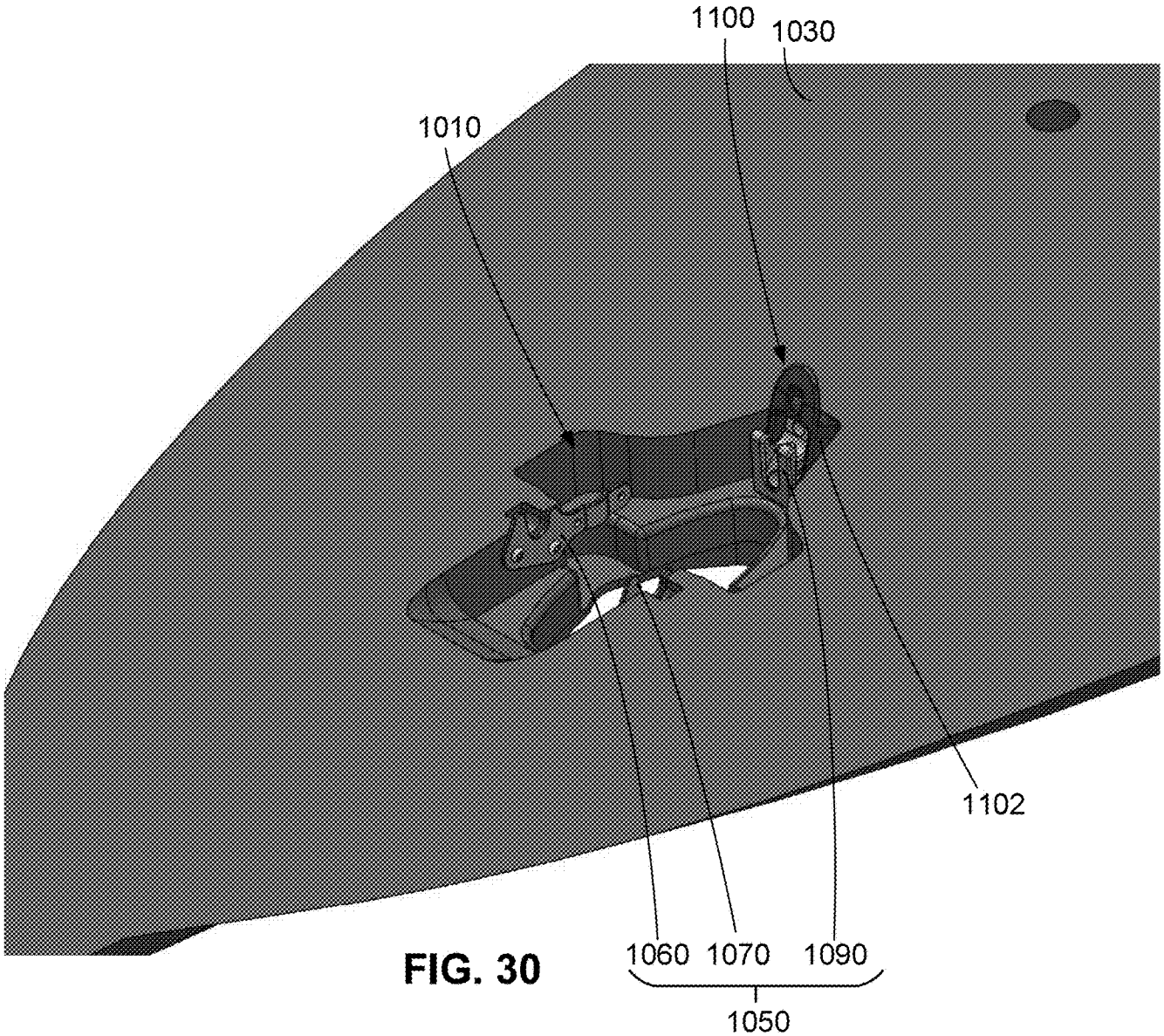
FIG. 30 is a top perspective view of the hull portion and support assembly of FIG. 28.

FIGS. 28-30 illustrate an example of a support opening 1010, a hull 1030, and a support assembly 1050. The support assembly 1050 includes a rightward support device 1060, a leftward support device 1070, and a rearward support device 1090. FIGS. 28-30 show a portion of the hull 1030 in a vicinity of the support assembly 1050 and in particular, illustrates the support assembly 1050 attached to the hull 1030. The support opening 1010 is at least partially defined by the hull 1030, similar to examples described in this disclosure in which the support opening is also at least partially defined by the hull, e.g., the implementations of FIGS. 16, 17, and 18A-18B.

The rightward and leftward support devices 1060, 1070 are plates that are attachable to the hull 1030 and that are configured to support a module, e.g., the propulsion mechanism 1020, in the support opening 1010. The rightward and leftward support devices 1060, 1070 are indexed to slots for receiving a shaft 1022 of the propulsion mechanism 1020. In this regard, the shaft 1022 can bear on the support devices 1060, 1070 as well as corresponding bearing surfaces defined by the hull 1030.

The support devices 1060, 1070, and 1090 are attached to the hull 1030, e.g., via fasteners through holes similar to the mechanism for fastening the support devices described with respect to the implementations of FIGS. 16, 17, and 18A-18B. For example, the fasteners can be threaded fasteners. The hull 1030 can be formed to include a rightward mounting device 1032, a leftward mounting device (not shown), and a rearward mounting device 1036 that receive fasteners for attaching the support devices 1060, 1070, 1090 to the hull 1030. The mounting devices can each receive one or more fasteners. In the example shown in FIGS. 28-30, the mounting devices each receive two fasteners to mount the corresponding one of the support devices 1060, 1070, 1090 to the hull 1030. In this example, the mounting devices are brass inserts including two spaced-apart threaded openings to receive fasteners engaged with the support devices 1060, 1070, 1090 to allow the fasteners to mount the support devices 1060, 1070, 1090 to the hull 1030.

In some implementations in this disclosure, a locking mechanism is attached to a leftward portion of the support assembly and/or a rightward portion of the support assembly, e.g., the locking mechanism 170. In the example illustrated in FIGS. 28-30, a locking mechanism 1100 is attached to the rearward support device 1090. The locking mechanism 1100 can include features similar to those discussed with respect to the locking mechanism 170, except that the locking mechanism 1100 is positioned on the rearward support device 1090 instead of the leftward and rightward support devices 1060, 1070. The locking mechanism 1100 includes a lever 1102 rotatably mounted to the rearward support device 1090. The propulsion mechanism 1020, when mounted to the support assembly 1050 and in the support opening 1010, is locked in place by the locking mechanism 1100. The locking mechanism 1100 can include, for example, a cam mechanism that blocks the propulsion mechanism 1020 from being removed from the support assembly 1050. The lever 1102, when manually operated, can actuate the cam mechanism to disengage from the propulsion mechanism 1020, thereby allowing the propulsion mechanism 1020 to be removed from the support assembly 1050 and the support opening 1010.

Figure 31:
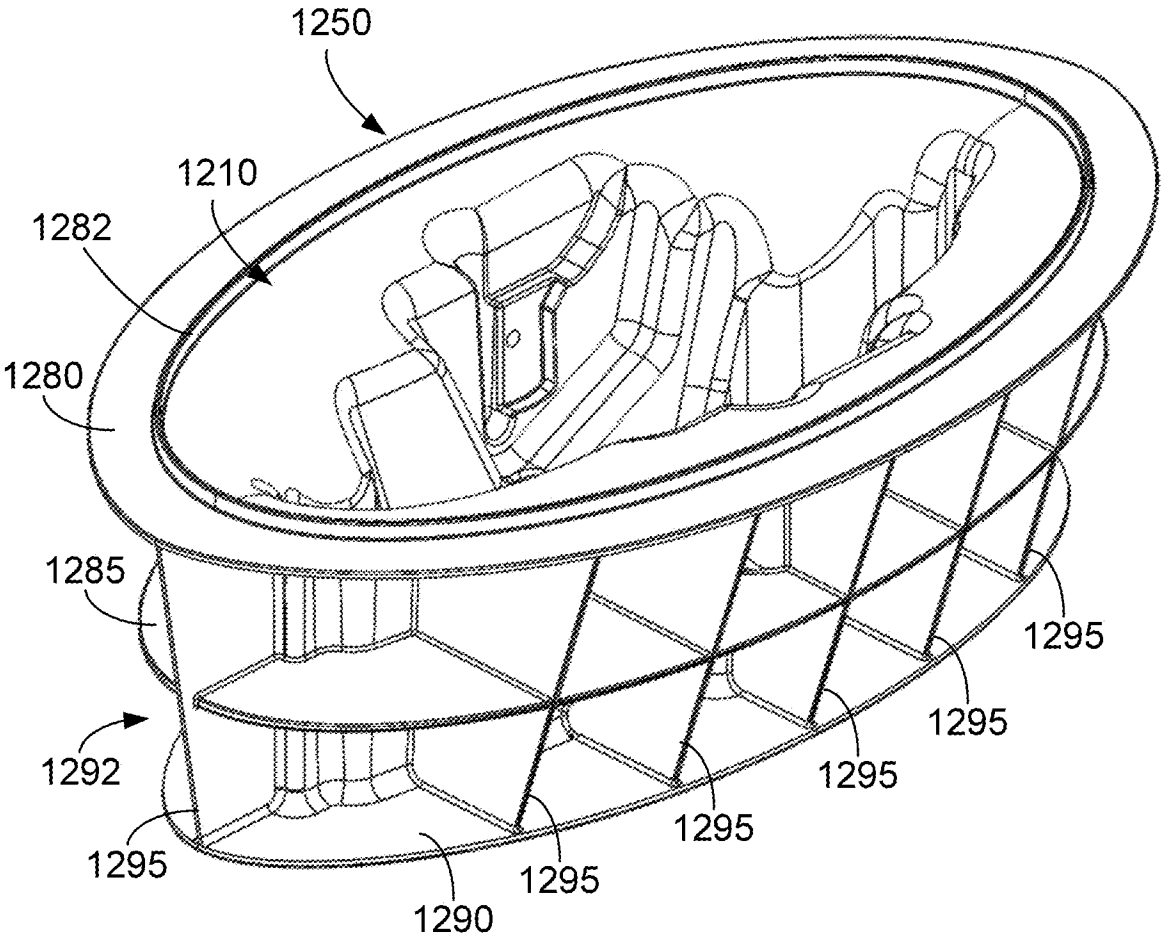
FIGS. 31-32 are top perspective and top views of a further example of a support assembly.
Figure 32:
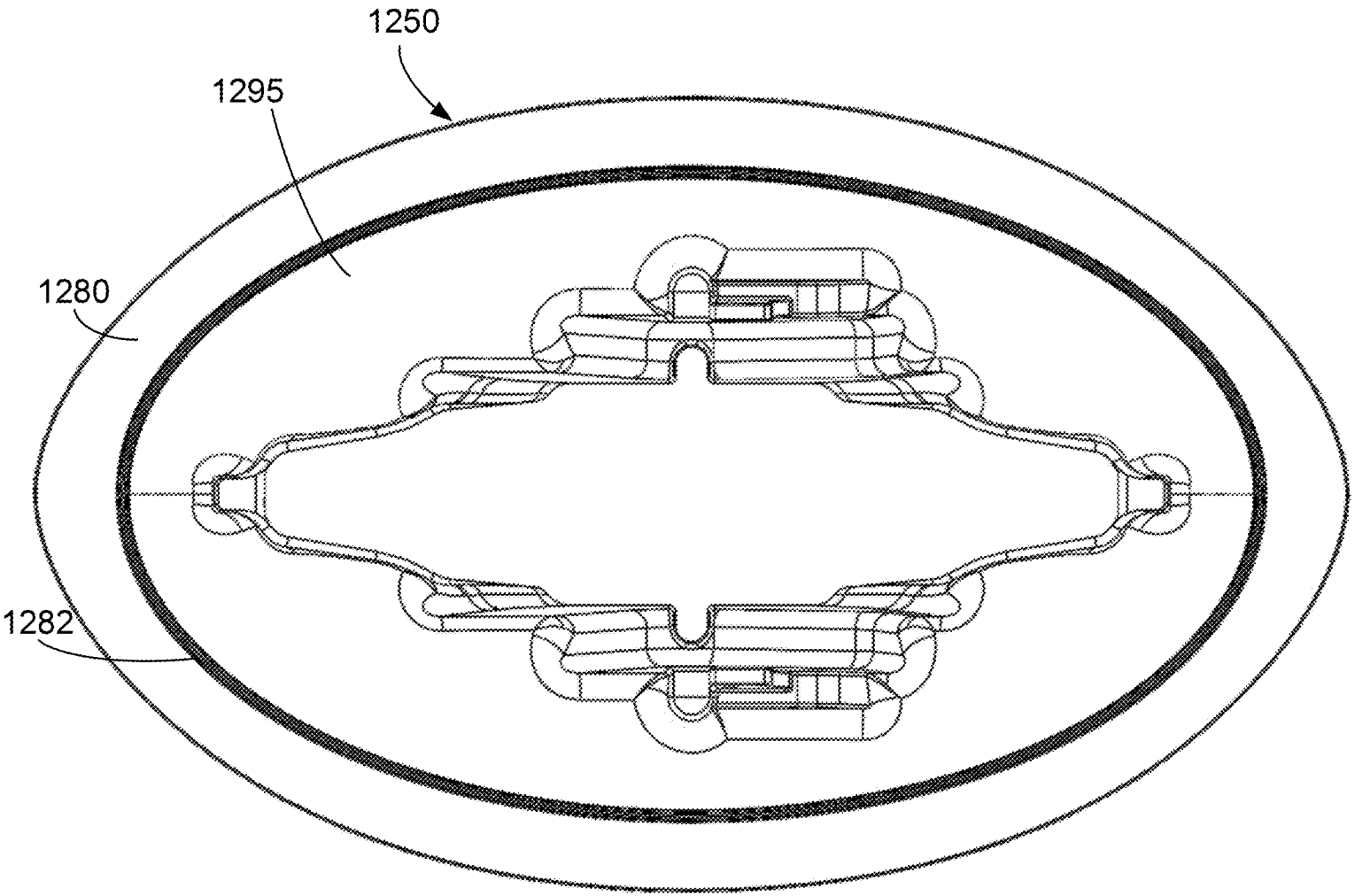
Figure 34:
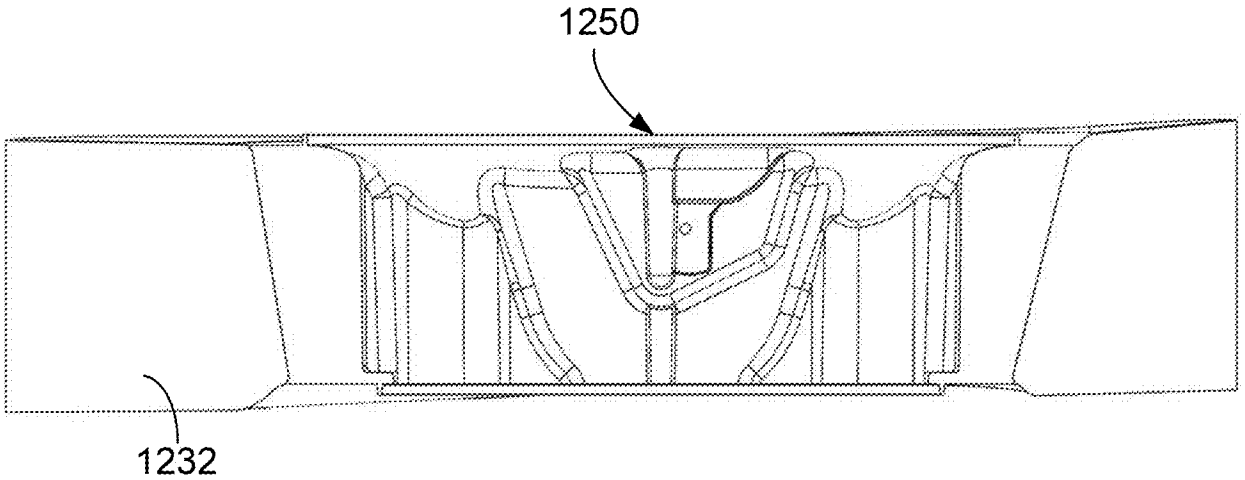
FIGS. 34-36 illustrate assemblies formed during the process of FIG. 33.
Figure 35:
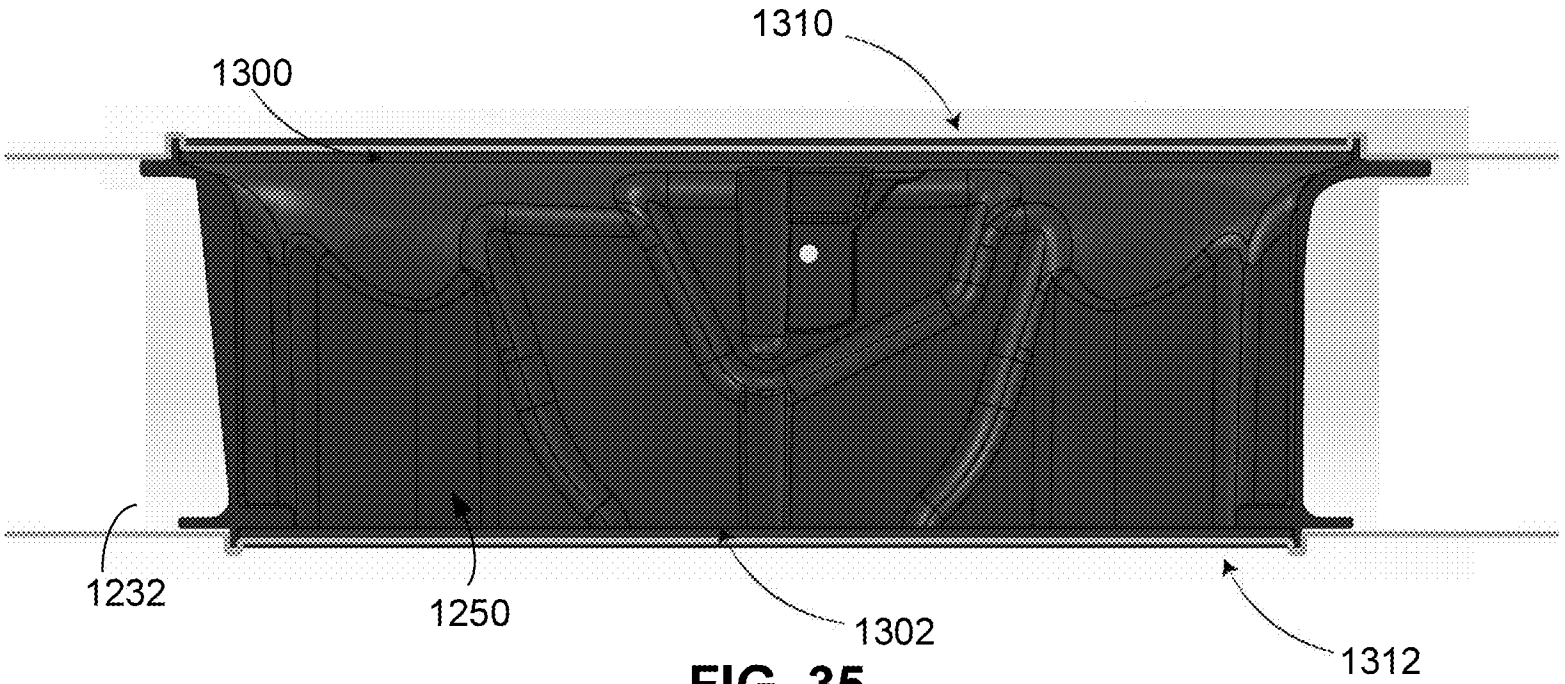

FIGS. 31, 32, and 34-36 illustrate another example of a support assembly 1250 that is integral to the hull 1230, only a portion of which is depicted in FIG. 35. Referring mainly to FIGS. 31 and 32, the support assembly 1250 is similar to the support assembly 150 described with respect to FIGS. 4A-4D. The support assembly 1250 includes an upper flange 1280, a middle flange 1285, a lower flange 1290, and a body 1292 extending between the flanges 1280, 1285, 1290. The support assembly 1250 further includes transverse ribs 1295 around a perimeter of the support assembly 1250. A raised portion 1282 is positioned on the upper flange 1280. The support assembly 1250, similar to the support assembly 150, defines, at least in part, a support opening 1210 of the watercraft. Other features of the support assembly 150—including features to accommodate a locking mechanism, bearing and support surfaces, and other features of the support assembly 150—can also be present in this example.

During a manufacturing and assembly process, the support assembly 1250 is formed in the hull 1230. The hull 1230 includes a core 1232 (FIG. 35), a shell 1234 (FIG. 36), and the support assembly 1250. The support assembly 1250 is joined to the core 1232 and the shell 1234 in an insert-molding process.

Figure 33:
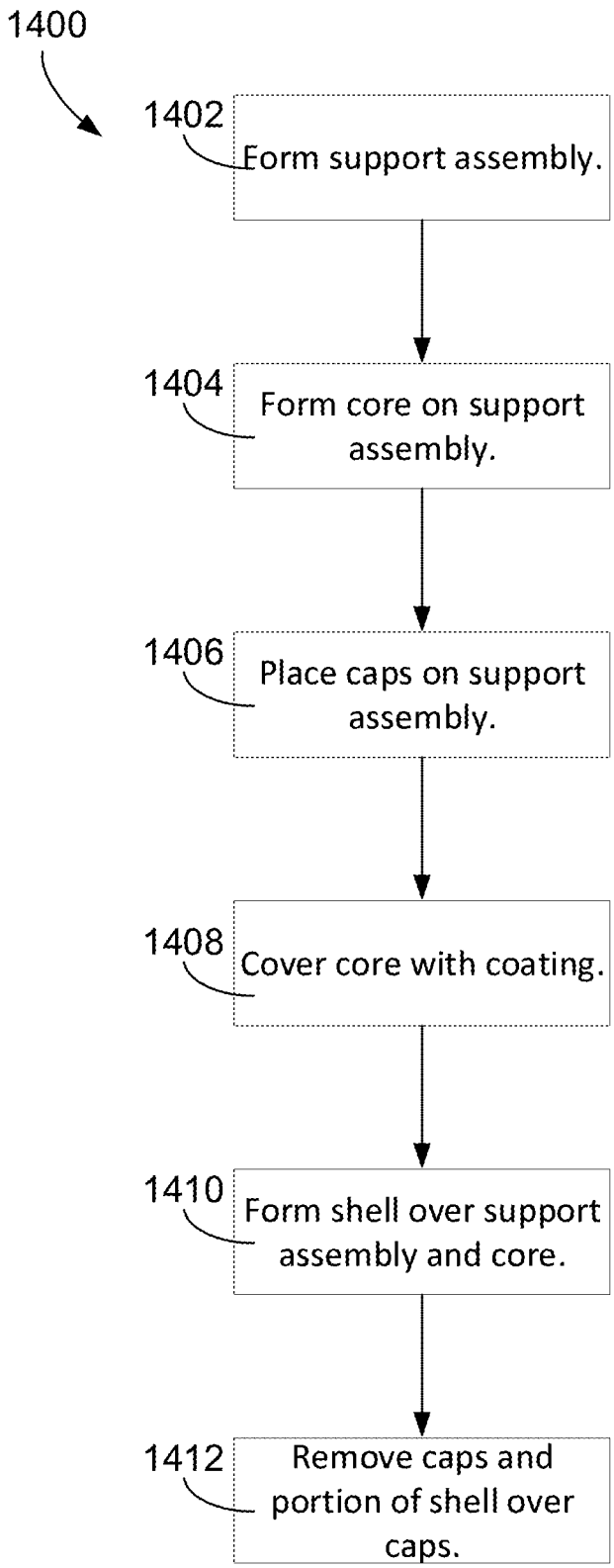
FIG. 33 illustrates a process for forming a watercraft including a hull and the support assembly of FIGS. 31-32.

In an example process 1400 shown in FIG. 33, at an operation 1402, the support assembly 1250 (as shown in FIGS. 31-32) is formed. The support assembly 1250 is, for example, injection-molded. Other ways for forming a single component such as the support assembly 1250 are possible, such as machining, additive manufacturing, and other manufacturing methods.

At an operation 1404, the core 1232 is formed on the support assembly 1250. For example, the support assembly 1250 is placed into a mold for the core 1232. Then, foam pellets are injected into the mold, and steam is used to expand the foam pellets and fuse the foam pellets together to create a continuous core 1232. The foam pellets can, for example, be polystyrene foam pellets that are expanded using steam to form expanded polystyrene (EPS) foam. The support assembly 1250 is locked to the core 1232 due to the geometry of the core 1232 and the support assembly 1250. For example, the flanges 1280, 1285, 1290 and the transverse ribs 1295 allow the support assembly 1250 to be locked to the core 1232 when the core 1232 is formed around the support assembly 1250. FIG. 34 illustrates an example of the support assembly 1250 with the core 1232 overmolded on the support assembly 1250 and/or the support assembly 1250 insert-molded to the core 1232. This intermediate assembly including the support assembly 1250 and the core 1232 can then be taken out of the mold for the core 1232.

At an operation 1406, caps 1300, 1302 (FIG. 35) are placed on upper and lower portions of the support assembly 1250. The caps 1300, 1302 serve to prevent material in further manufacturing operations from being injected or placed in the central opening of the support assembly 1250. The caps 1300, 1302 are formed a stiff polymer component that maintains its form during the subsequent manufacturing operations.

At an operation 1408, the core 1232 is covered with a coating. The coating can include one or more layers of structural and/or adhesive components that prepare the core 1232 for being joined to the shell 1234 of the hull 1230. For example, the coating can include a layer of fiberglass cloth that is wrapped around the core 1232 and the caps 1300, 1302. Portions of fiberglass cloth forming hoops can be placed on the upper and lower portions of the support assembly 1250. One of these portions of fiberglass cloth can extend from the upper portion of the support assembly 1250 to an adjacent portion of the core 1232. The other of these portions of fiberglass cloth can extend from the lower portion of the support assembly 1250 to an adjacent portion of the core 1232. These hoop-shaped portions of fiberglass cloth can improve the connection strength between the core 1232 and the support assembly 1250 after the shell 1234 is formed over the core 1232 and the support assembly 1250. The coating can further include epoxy that is poured over the fiberglass cloth.

At an operation 1410, the shell 1234 is formed over the support assembly 1250, the caps 1300, 1302, and the core 1232. For example, an intermediate assembly including the support assembly 1250, the caps 1300, 1302, the core 1232, and the coating are placed in a mold. Plastic sheets are placed in the mold (e.g., before the intermediate assembly is placed in the mold) to line a cavity within the mold. The cavity is heated to cause the plastic sheets to form over the intermediate assembly. The coating on the intermediate assembly can fuse with the plastic sheets as a result of the heat, thereby strengthening the shell 1234 formed as part of this operation. FIG. 35 illustrates an example of an intermediate assembly formed in the operation 1410, the intermediate assembly including the support assembly 1250, the caps 1300, 1302, the core 1232, and the coating. An upper plastic sheet 1310 and a lower plastic sheet 1312 can be placed in the mold and then formed over the intermediate assembly.

Figure 36:
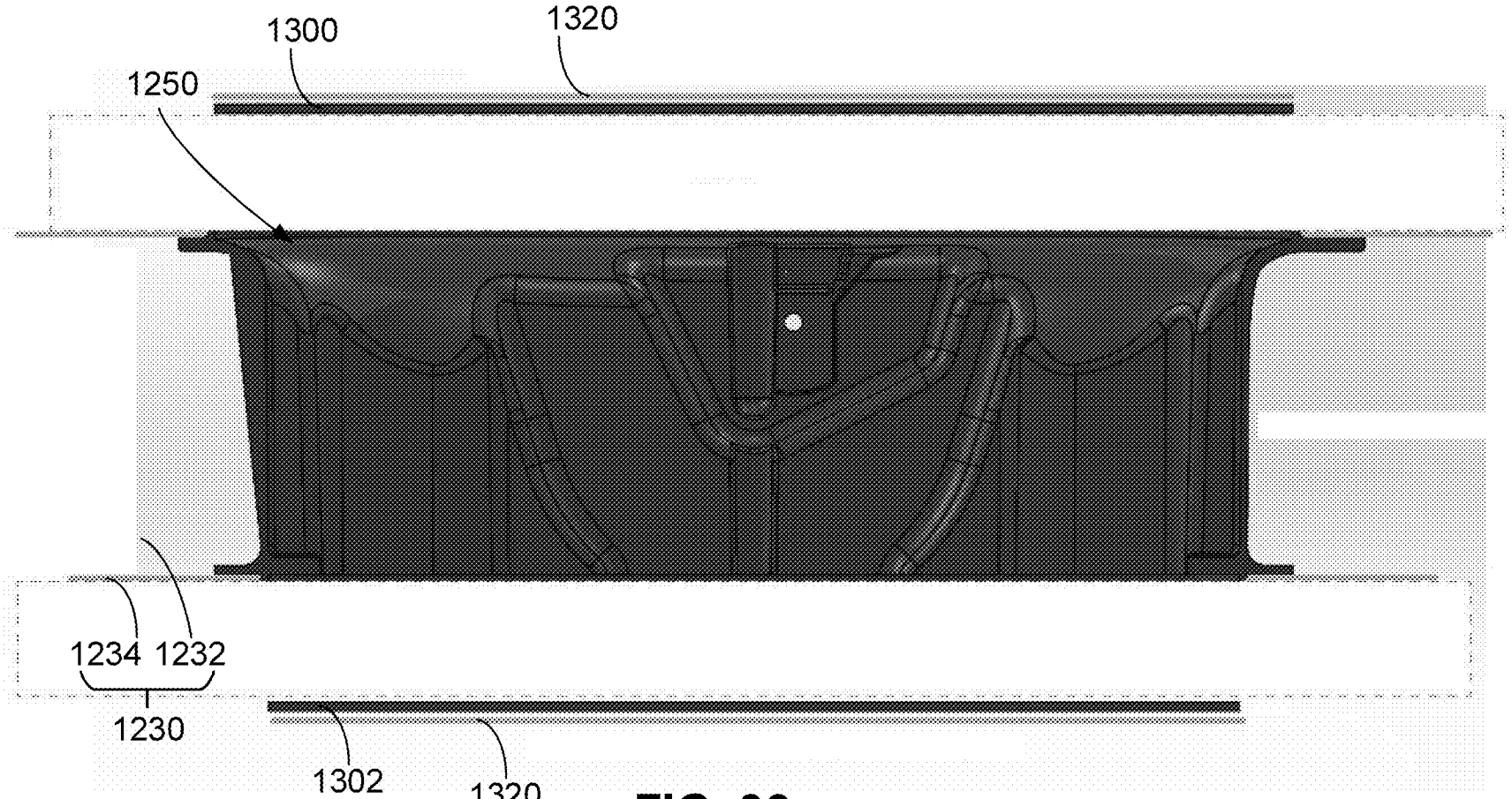

At an operation 1412, the caps 1300, 1302 and material 1320 of the shell 1234 overlying the caps 1300, 1302 are removed, as shown in FIG. 36. For example, a trimming process can be used to remove these components. The raised portion 1282 can serve as a guide for where the trimming process occurs. The hull 1230, including the shell 1234, the core 1232, and the support assembly 1250, is formed. The support assembly 1250 is integral and inseparable from the hull 1230, e.g., from the core 1232 and the shell 1234.

In some implementations, the watercraft 100 is a kayak. In other implementations, the watercraft can be a paddleboard, a canoe, a raft, a stand-up watercraft, a pedal-propelled boat, or other appropriate watercraft. The propulsion mechanism 120 is described as a pedal-based propulsion mechanism. In other implementations, the propulsion mechanism can be electrically driven, manually driven with hands, manually driven with feet, or driven in another appropriate manner.

As described, the support openings described in this disclosure (e.g., the support openings 110, 210, 310, 410, 510, 610, 710, 810, 910, 1010, 1210) are configured to receive a propulsion mechanism and thereby mount the propulsion mechanism to the watercraft. The support openings can be defined by surfaces of the support assemblies (e.g., the support assemblies 150, 250, 350, 450, 550, 650, 750, 850, 950, 1050, 1250), surfaces of the hull (e.g., the hulls 130, 230, 330, 430, 530, 630, 730, 830, 930, 1030, 1230), or a combination of surfaces of the support assemblies and surfaces of the hull. At least some of the surfaces of the support openings can be upwardly-directed to abut a housing of the propulsion mechanism when received in the support opening. These upwardly-directed surfaces, as described in this disclosure, may vary in implementations. In some implementations, the upwardly-directed surfaces to support the propulsion mechanism in a vertical direction include only surfaces on the support assemblies. In other implementations, the upwardly-directly surfaces can include surfaces of the support assemblies and surfaces of the hull.

Features of the support assemblies described in this disclosure (e.g., the support assemblies 150, 250, 350, 450, 550, 650, 750, 850, 950, 1050, 1250) can be combined in implementations. While not shown in all of the figures of the support assemblies, a locking mechanism can be present to mount the shaft of the propulsion mechanism to the watercraft.

This disclosure describes several implementations in which fasteners are used to fasten the support assemblies to the hulls, e.g., the implementations represented in FIGS. 13A-15C, the implementations represented in FIGS. 16-18B, the implementations represented in FIGS. 19A-21C, and the implementations represented in FIGS. 22A-24.

In alternative implementations, instead of fasteners, bonding material such as an adhesive can be used to bond the hulls to the support assemblies.

In implementations, the support assemblies (e.g., the support assemblies 150, 250, 350, 450, 550, 650, 750, 850, 950, 1050, 1250) and the hulls (e.g., the hulls 130, 230, 330, 430, 530, 630, 730, 830, 930, 1030, 1230) described in this disclosure can be formed of polymers. For example, the support assemblies and the hulls can be formed of acrylonitrile butadiene styrene (ABS), acetal, epoxy matrices, acrylic, polyethylene terephthalates (PET), polyimides, polyethylene, polypropylene, polysterene, polyurethane, polyvinyl chloride, polycarbonate (PC), ABS-PC, polyamides, vinyl, silicone, polyesters, fluoropolymers, phenolic polymers, or other polymers, or composite materials including one or more these polymers. Hydrophobic polymers can include some acetal-based polymers, polyethylene-based polymers, and polypropylene-based polymers.

In implementations in which adhesives are used to bond components to one another, the polymers are preferably not hydrophobic. Furthermore, the support assemblies and the hulls can be formed of the same material. For example, in such implementations, the polymer used to form the support assembly and the hull can be ABS.

In implementations in which adhesives are not used, such as implementations in which the support assembly is inserted molded to the hull in implementations in which the support assembly is fastened to the hull, the support assembly and the hull are preferably formed of polyethylene. In such implementations, the support assemblies and the hulls can be formed of the same material.

Accordingly, other implementations are within the scope of the claims.

What is claimed is:

1. A watercraft comprising:

a hull comprising a rightward slot to receive a rightward support device and a leftward slot to receive a leftward support device;

an opening extending vertically through the hull, the hull at least partially defining the opening; and a support assembly configured to mount a propulsion mechanism to the watercraft, wherein the support assembly comprises:

the rightward support device attached to the hull, positioned between a forward portion of the opening and a rearward portion of the opening, and at least partially defining a right lateral portion of the opening, and the leftward support device attached to the hull, positioned between the forward portion of the opening and the rearward portion of the opening, and at least partially defining a left lateral portion of the opening.

2. The watercraft of claim 1, wherein a dimension of the opening along a fore-aft axis of the watercraft is longer than a dimension of the opening along a left-right axis of the watercraft.

3. The watercraft of claim 2, wherein a dimension of the rightward support device along a fore-aft axis of the watercraft is less than 50% of the dimension of the opening, and a dimension of the leftward support device is less than 50% of the dimension of the opening.

4. The watercraft of claim 1, wherein the rightward support device comprises a first bearing surface to mount a shaft of the propulsion mechanism to the watercraft, and the leftward support device comprises a second bearing surface to mount the shaft of the propulsion mechanism to the watercraft.

5. The watercraft of claim 4, further comprising a locking mechanism to releasably lock the shaft of the propulsion mechanism to the watercraft when the propulsion mechanism is mounted to the support assembly.

6. The watercraft of claim 5, wherein the locking mechanism is positioned on a rear portion of the support assembly.

7. The watercraft of claim 5, wherein the locking mechanism comprises:

a first lever comprising a first cam surface to engage the shaft of the propulsion mechanism when the propulsion mechanism is mounted to the support assembly, the first lever being rotatably mounted to the rightward support device, and a second lever comprising a second cam surface to engage the shaft of the propulsion mechanism when the propulsion mechanism is mounted to the support assembly, the second lever being rotatably mounted to the leftward support device.

8. The watercraft of claim 1, wherein a forward portion of the opening is defined by an upwardly-directed surface to abut a forward portion of the propulsion mechanism when the propulsion mechanism is mounted to the support assembly.

9. The watercraft of claim 8, wherein a rearward portion of the opening is defined by an upwardly-directed surface to abut a rear portion of the propulsion mechanism when the propulsion mechanism is mounted to the support assembly.

10. The watercraft of claim 1, wherein the hull comprises an upper portion and a lower portion, and the rightward and leftward support devices extend along the upper portion and the lower portion of the hull.

11. The watercraft of claim 10, wherein the upper portion of the hull is welded to the lower portion of the hull.

12. The watercraft of claim 1, wherein the hull comprises an inner surface at least partially defining the opening, the rightward slot and the leftward slot being recessed relative to the inner surface.

13. The watercraft of claim 12, wherein the rightward slot and the leftward slot are recessed relative to a top surface of the hull.

14. The watercraft of claim 1, further comprising the propulsion mechanism, wherein the propulsion mechanism is a manually-operable propulsion mechanism.

15. The watercraft of claim 1, wherein the rightward support device and the leftward support device are fastened to an upper portion of the hull.

16. The watercraft of claim 15, wherein the rightward support device and the leftward support device are fastened to the upper portion of the hull via threaded fasteners.

17. The watercraft of claim 1, wherein an upper portion of the hull comprises an first upward facing surface to abut an upper portion of the rightward support device and a second upwardly-directed surface to abut an upper portion of the leftward support device.

18. The watercraft of claim 1, wherein the support assembly further comprises a forward support device attached to the hull and at least partially defining the forward portion of the opening.

19. The watercraft of claim 18, wherein the forward support device comprises an upwardly-directed surface to abut a forward portion of the propulsion mechanism when the propulsion mechanism is mounted to the support assembly.

20. The watercraft of claim 18, wherein the support assembly further comprises a rear support assembly attached to the hull and at least partially defining the rear portion of the opening.

21. The watercraft of claim 20, wherein the forward support device and the rear support assembly are fastened to the hull.

22. The watercraft of claim 18, wherein the hull comprises a forward slot to receive the forward support device.

23. The watercraft of claim 22, wherein the hull comprises an inner surface at least partially defining the opening, the forward slot being recessed relative to the inner surface.

24. The watercraft of claim 23, wherein the forward slot is recessed relative to a top surface of the hull.

25. The watercraft of claim 1, wherein:

the rightward support device comprises an upper portion and a lower portion, wherein an upper portion and a lower portion of the hull are at least partially positioned between the upper portion of the rightward support device and the lower portion of the rightward support device, and the leftward support device comprises an upper portion and a lower portion, wherein the upper portion and the lower portion of the hull are at least partially positioned between the upper portion of the leftward support device and the lower portion of the leftward support device.

26. The watercraft of claim 25, wherein the upper portion of the rightward support device and the lower portion of the rightward support device are integral with one another.

27. The watercraft of claim 25, wherein the upper portion of the rightward support device and the lower portion of the leftward support device are separated by a gap, wherein the upper portion and the lower portion of the hull extend into the gap.

28. The watercraft of claim 27, wherein the rightward support device comprises a connection member connecting the upper portion and the lower portion of the rightward support device, the connection member being integral with the upper portion and the lower portion of the rightward support device.

29. The watercraft of claim 28, wherein the upper portion, the lower portion, and the connection member are part of a single component formed in a molding process.

30. The watercraft of claim 27, wherein the upper portion of the rightward support device is a top member of the rightward support device, and the lower portion of the rightward support device is a bottom member of the rightward support device, the top member and the bottom member of the rightward support device being distinct from one another.

31. The watercraft of claim 25, wherein the upper portion and the lower portion of the hull comprise flanges positioned between the upper portion and the lower portion of the rightward support device.

32. The watercraft of claim 31, wherein the rightward support device is fastened to the flanges.

33. The watercraft of claim 32, wherein the rightward support device is fastened to the flanges via one or more threaded fasteners extend through the lower portion of the rightward support device, through the hull, and through the upper portion of the rightward support device.

34. The watercraft of claim 1, wherein an upper portion of the hull comprises a rightward slot to receive the rightward support device, wherein the rightward slot tapers downwardly along the upper portion of the hull.

35. The watercraft of claim 1, wherein the rightward support device and the hull are fixed to one another via an insert-molding process.

* * * * *